US007990335B2

(12) United States Patent
Schneider et al.

(10) Patent No.: US 7,990,335 B2
(45) Date of Patent: Aug. 2, 2011

(54) ANTENNA ASSEMBLIES WITH ANTENNA ELEMENTS AND REFLECTORS

(75) Inventors: Richard E. Schneider, Wildwood, MO (US); John Edwin Ross, III, Moab, UT (US); Corey Feit, St. Louis, MO (US); Dale Picolet, House Springs, MO (US)

(73) Assignee: Antennas Direct, Inc., Ellisville, MO (US)

( * ) Notice: Subject to any disclaimer, the term of this patent is extended or adjusted under 35 U.S.C. 154(b) by 0 days.

(21) Appl. No.: 12/953,007

(22) Filed: Nov. 23, 2010

(65) Prior Publication Data

US 2011/0102280 A1 May 5, 2011

Related U.S. Application Data

(63) Continuation-in-part of application No. 12/040,464, filed on Feb. 29, 2008, now Pat. No. 7,839,347, and a continuation of application No. 12/606,636, filed on Oct. 27, 2009, which is a continuation-in-part of application No. 12/050,133, filed on Mar. 17, 2008, now Pat. No. 7,609,222, which is a continuation-in-part of application No. 29/304,423, filed on Feb. 29, 2008, now Pat. No. Des. 598,433, which is a continuation-in-part of application No. 29/305,294, filed on Mar. 17, 2008, now Pat. No. Des. 604,276, which is a continuation-in-part of application No. 12/040,464, and a continuation of application No. 12/050,133, which is a continuation-in-part of application No. PCT/US2008/061908, filed on Apr. 29, 2008.

(60) Provisional application No. 60/992,331, filed on Dec. 5, 2007, provisional application No. 61/034,431, filed on Mar. 6, 2008.

(51) Int. Cl.
*H01Q 3/00* (2006.01)

(52) U.S. Cl. ..... 343/882; 343/741; 343/878

(58) Field of Classification Search ..... 343/741, 343/878, 880, 882
See application file for complete search history.

(56) References Cited

U.S. PATENT DOCUMENTS 2,220,008 A * 10/1940 Woodward et al. ..... 342/428
(Continued)

FOREIGN PATENT DOCUMENTS

CN ZL200820007283.2 5/2009
(Continued)

OTHER PUBLICATIONS

IEEE Spectrum: Antennas for the New Airwaves, http://www.spectrum.ieee.org/print/7328, Published Feb. 2009, 9 pages, Authors Richard Schneider and John Ross.

(Continued)

*Primary Examiner* — David G Phan
(74) *Attorney, Agent, or Firm* — Harness, Dickey & Pierce, P.L.C.

(57) ABSTRACT

According to various aspects, exemplary embodiments are provided of antenna assemblies. In an exemplary embodiment, an antenna assembly generally includes at least one tapered loop antenna element having a generally annular shape with an opening. An antenna assembly may also include a rotatably convertible support including a base and an upper portion coupled to a tapered loop antenna element in some embodiments. The upper portion is rotatable relative to the base between a first configuration for supporting the tapered loop antenna element on a horizontal surface and a second configuration for supporting the tapered loop antenna element from a vertical surface.

24 Claims, 38 Drawing Sheets

U.S. PATENT DOCUMENTS

| | | | | |
|---|---|---|---|---|
| 2,437,251 | A * | 3/1948 | Frische et al. | 244/184 |
| 2,480,155 | A | 8/1949 | Masters | |
| 2,589,578 | A * | 3/1952 | Sabins | 343/869 |
| D170,203 | S | 8/1953 | Leonard | |
| D171,560 | S | 2/1954 | Rutter | |
| D177,200 | S | 3/1956 | Valiulis | |
| D179,111 | S | 11/1956 | Ballan et al. | |
| 3,015,101 | A | 12/1961 | Turner et al. | |
| 3,123,826 | A | 3/1964 | Durham | |
| 3,239,838 | A | 3/1966 | Kelleher | |
| 3,273,158 | A | 9/1966 | Fouts et al. | |
| D209,402 | S | 11/1967 | Burlingame | |
| D211,025 | S | 5/1968 | Callaghan | |
| 3,434,145 | A | 3/1969 | Wells | |
| 3,721,990 | A | 3/1973 | Gibson et al. | |
| 3,828,867 | A * | 8/1974 | Elwood | 175/45 |
| 4,184,163 | A | 1/1980 | Woodward | |
| D318,673 | S | 7/1991 | Terk | |
| D327,690 | S | 7/1992 | Ogawa et al. | |
| 5,280,645 | A | 1/1994 | Nguyen et al. | |
| D344,731 | S | 3/1994 | Witzky | |
| 5,313,218 | A | 5/1994 | Busking | |
| D414,495 | S | 9/1999 | Heiligenstein et al. | |
| 6,590,541 | B1 | 7/2003 | Schultze | |
| 6,593,886 | B2 | 7/2003 | Schantz | |
| 6,680,708 | B2 | 1/2004 | Yamaki | |
| 6,885,352 | B2 | 4/2005 | Lee et al. | |
| 7,091,925 | B1 | 8/2006 | Wang | |
| 7,209,089 | B2 | 4/2007 | Schantz | |
| D544,471 | S | 6/2007 | Wang | |
| 7,239,290 | B2 | 7/2007 | Poilasne et al. | |
| D550,217 | S | 9/2007 | Schneider | |
| D552,088 | S | 10/2007 | Schneider | |
| D598,433 | S | 8/2009 | Schneider et al. | |
| D598,434 | S | 8/2009 | Schneider et al. | |
| 7,609,222 | B2 | 10/2009 | Schneider et al. | |
| D604,276 | S | 11/2009 | Schneider et al. | |
| 7,693,570 | B2 * | 4/2010 | Green et al. | 600/415 |
| 7,839,347 | B2 | 11/2010 | Schneider et al. | |
| 7,898,496 | B2 * | 3/2011 | Olsen et al. | 343/878 |
| 2002/0158798 | A1 | 10/2002 | Chiang et al. | |
| 2003/0071757 | A1 | 4/2003 | Yamaki | |
| 2004/0090379 | A1 | 5/2004 | Fourdeux et al. | |
| 2004/0090385 | A1 | 5/2004 | Green | |
| 2004/0113841 | A1 | 6/2004 | Louzir et al. | |
| 2004/0217912 | A1 | 11/2004 | Mohammadian | |
| 2005/0088342 | A1 | 4/2005 | Parsche | |
| 2005/0162332 | A1 | 7/2005 | Schantz | |
| 2005/0280582 | A1 | 12/2005 | Powell et al. | |
| 2006/0033665 | A1 | 2/2006 | Yang | |
| 2006/0055618 | A1 | 3/2006 | Poilasne et al. | |
| 2006/0077115 | A1 | 4/2006 | Oh et al. | |
| 2006/0103577 | A1 | 5/2006 | Lee | |
| 2006/0164304 | A1 | 7/2006 | Huang et al. | |
| 2007/0069955 | A1 | 3/2007 | McCorkle | |
| 2007/0200769 | A1 | 8/2007 | Nakano et al. | |
| 2008/0094291 | A1 | 4/2008 | Bystrom et al. | |
| 2008/0211720 | A1 | 9/2008 | Hansen | |
| 2008/0258980 | A1 | 10/2008 | Chen et al. | |
| 2008/0291345 | A1 | 11/2008 | Schneider | |
| 2009/0058732 | A1 | 3/2009 | Nakano et al. | |
| 2009/0073067 | A1 | 3/2009 | Soler Castany et al. | |
| 2009/0146899 | A1 | 6/2009 | Schneider et al. | |
| 2009/0146900 | A1 | 6/2009 | Schneider et al. | |
| 2010/0045551 | A1 | 2/2010 | Schneider et al. | |

FOREIGN PATENT DOCUMENTS

| | | |
|---|---|---|
| CN | ZL200830119996.3 | 5/2009 |
| CN | 101453057 | 6/2009 |
| CN | ZL200830119997.8 | 7/2009 |
| CN | ZL200830009139.8 | 9/2009 |
| EP | 1555717 | 7/2005 |
| EP | 1653560 | 5/2006 |
| EP | 1753080 | 2/2007 |
| EP | 000946587-0001 | 5/2008 |
| EP | 000946587-0002 | 5/2008 |
| EP | 000946587-0003 | 5/2008 |
| EP | 000946587-0004 | 5/2008 |
| EP | 000946587-0005 | 5/2008 |
| EP | 000946587-0006 | 5/2008 |
| EP | 000946587-0007 | 5/2008 |
| EP | 08747115.7 | 6/2010 |
| EP | 10172435.9 | 8/2010 |
| GB | 2263360 | 7/1993 |
| HK | 1131703 A | 1/2010 |
| JP | 1213590 | 6/2004 |
| JP | 1286151 | 9/2006 |
| TW | D112283 | 8/2006 |
| TW | D117777 | 6/2007 |
| TW | D117778 | 6/2007 |
| TW | D119092 | 9/2007 |
| TW | 200926506 | 6/2009 |
| TW | D129744 | 7/2009 |
| TW | D129745 | 7/2009 |
| TW | D129746 | 7/2009 |
| WO | WO2009/073249 | 6/2009 |

OTHER PUBLICATIONS

Antenna Engineering Handbook, 3rd Edition, Edited by Richard C. Johnson, McGraw Hill, 1993, pp. 5-13 to 5-16 (4 pages).

One-Element Loop Antenna with Finite Reflector, B. Rojarayanont and T. Sekiguchi, Electronics & Communications in Japan, vol. 59-B, No. 5, May 1976, p. 68 (1 page).

Frequency-and Time-Domain Modeling of Tapered Loop Antennas in Ultra-Wideband Radio Systems, Shiou-Li Chen and Shau-Gang Mao, Graduate Institute of Computer and Communication Engineer, pp. 179-182, IEEE copyright notice 2006 (4 pages).

Planar Miniature Tapered-Slot-Fed Annular Slot Antennas for Ultrawide-Band Radios, Tzyh-Ghuang Ma, Student Member, and Shyh-Kang, Jeng, Senior Member, IEEE, IEEE Transactions on Antennas and Propagation, vol. 53, No. 3, Mar. 2005, pp. 1194-1202 (9 pages).

Self-Mutual Admittances of Two Identical Circular Loop Antennas in a Conducting Medium and in Air, K. Lizuka, Senior Member, IEEE, R. W. P. King, Fellow, IEEE, and C. W. Harrison, Jr., Senior Member, IEEE, IEEE Transactions on Antennas and Propagation, vol. AP014, No. 4, Jul. 1966, pp. 440-450 (11 pages).

A Broadband Eccentric Annular Slot Antenna, Young Hoon Suh and Ikmo Park, Department of Electrical Engineering, Ajou University, pp. 94-97, IEEE copyright notice 2001 (4 pages).

A Printed Crescent Patch Antenna for Ultrawideband Applications, Ntsanderh C. Azenui an H.Y.D. Yang, IEEE Antennas and Wireless Propragation Letters, vol. 6, 2007, pp. 113-116 (4 pages).

Design of Compact Components for Ultra Wideband Communication Front Ends, Marek Bialkowski, Amin Abbosh, and Hing Kan, School of Information Technology and Electrical Engineering, The University of Queensland (4 pages).

Office Action issued by the United States Patent and Trademark Office dated Mar. 11, 2010, for U.S. Appl. No. 12/040,464 (18 pages).

Office Action issued by the United States Patent and Trademark Office dated Sep. 3, 2010, for U.S. Appl. No. 12/040,464 (6 pages).

International Search Report issued by the International Searching Authority dated Jul. 8, 2008, for International Patent Application No. PCT/US2008/061908 (1 page).

International Preliminary Report on Patentability and Written Opinion issued by the International Searching Authority dated Jul. 8, 2008, for International Patent Application No. PCT/US2008/061908 (9 pages).

European Supplementary Search Report and Opinion dated Oct. 7, 2010, issued by the European Patent Office for European Patent Application No. EP 08747115 (6 pages).

European Search Report dated Jan. 17, 2011, issued by the European Patent Office for European Patent Application No. EP 10193159.0 which is related to the instant application through a priority claim; (5 pages).

* cited by examiner

ANTENNA ASSEMBLIES WITH ANTENNA ELEMENTS AND REFLECTORS

CROSS-REFERENCE TO RELATED APPLICATIONS

This application is also a continuation-in-part of U.S. patent application Ser. No. 12/040,464 filed Feb. 29, 2008 (which issues Nov. 23, 2010 as U.S. Pat. No. 7,839,347), which, in turn, claimed the benefit of U.S. Provisional Application No. 60/992,331 filed Dec. 5, 2007.

This application is also a continuation of U.S. patent application Ser. No. 12/606,636 filed Oct. 27, 2009.

U.S. patent application Ser. No. 12/606,636 filed Oct. 27, 2009 was a continuation-in-part of:

(1) U.S. patent application Ser. No. 12/050,133 filed Mar. 17, 2008 (now U.S. Pat. No. 7,609,222, issued Oct. 27, 2009), which, in turn, was a continuation-in-part of U.S. Design patent application No. 29/304,423 filed Feb. 29, 2008 (now U.S. Design Pat. D598,433 issued Aug. 18, 2009) and also claimed the benefit of U.S. Provisional Patent Application No. 60/992,331 filed Dec. 5, 2007 and U.S. Provisional Patent Application No. 61/034,431 filed Mar. 6, 2008; and (2) U.S. patent application Ser. No. 12/040,464 filed Feb. 29, 2008, which, in turn, claimed the benefit of U.S. Provisional Patent Application No. 60/992,331 filed Dec. 5, 2007; and (3) U.S. Design patent application No. 29/305,294 filed Mar. 17, 2008 (now U.S. Design Pat. D604,276 issued Nov. 17, 2009), which, in turn, was a continuation-in-part of U.S. patent application Ser. No. 12/040,464 filed Feb. 29, 2008 and was a continuation of U.S. patent application Ser. No. 12/050,133 filed Mar. 17, 2008 (now U.S. Pat. No. 7,609,222, issued Oct. 27, 2009; and (4) PCT International Application No. PCT/US08/061,908 filed Apr. 29, 2008, which, in turn, claimed priority to U.S. Provisional Patent Application No. 60/992,331 filed Dec. 5, 2007, U.S. Provisional Patent Application No. 61/034,431 filed Mar. 6, 2008, U.S. patent application Ser. No. 12/040,464 filed Feb. 29, 2008, and U.S. patent application Ser. No. 12/050,133 filed Mar. 17, 2008.

The entire disclosures of the above applications are incorporated herein by reference.

FIELD

The present disclosure generally relates to antenna assemblies configured for reception of television signals, such as high definition television (HDTV) signals.

BACKGROUND

The statements in this section merely provide background information related to the present disclosure and may not constitute prior art.

Many people enjoy watching television. Recently, the television-watching experience has been greatly improved due to high definition television (HDTV). A great number of people pay for HDTV through their existing cable or satellite TV service provider. In fact, many people are unaware that HDTV signals are commonly broadcast over the free public airwaves. This means that HDTV signals may be received for free with the appropriate antenna.

SUMMARY

According to various aspects, exemplary embodiments are provided of antenna assemblies. In an exemplary embodiment, an antenna assembly generally includes at least one tapered loop antenna element having a generally annular shape with an opening. An antenna assembly may also include a rotatably convertible support including a base and an upper portion coupled to the tapered loop antenna element in some embodiments. The upper portion is rotatable relative to the base between a first configuration for supporting the tapered loop antenna element on a horizontal surface and a second configuration for supporting the tapered loop antenna element from a vertical surface.

In an exemplary embodiment, an antenna element configured for operating within a bandwidth ranging from about 470 megahertz to about 690 megahertz. The antenna element includes spaced-apart first and second end portions, a middle portion, and first and second curved portions extending from the respective first and second end portions to the middle portion such that the antenna element has a generally circular annular shape with a generally circular opening. The first and second curved portions gradually increase in width from the respective first and second end portions to the middle portion such that the middle portion is wider than the first and second end portions and such that an outer diameter of the antenna element is offset from a diameter of the generally circular opening. The first curved portion is a mirror image of the second curved portion.

According to various aspects, exemplary embodiments are provided of antenna assemblies. In one exemplary embodiment, an antenna assembly generally includes at least one antenna element having a generally annular shape with an opening. At least one reflector element is spaced-apart from the antenna element for reflecting electromagnetic waves generally towards the antenna element. Additional aspects provide methods relating to antenna assemblies, such as methods of using and/or making antenna assemblies.

Further aspects and features of the present disclosure will become apparent from the detailed description provided hereinafter. In addition, any one or more aspects of the present disclosure may be implemented individually or in any combination with any one or more of the other aspects of the present disclosure. It should be understood that the detailed description and specific examples, while indicating exemplary embodiments of the present disclosure, are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is in no way intended to limit the present disclosure, application, or uses.

Figure 1:
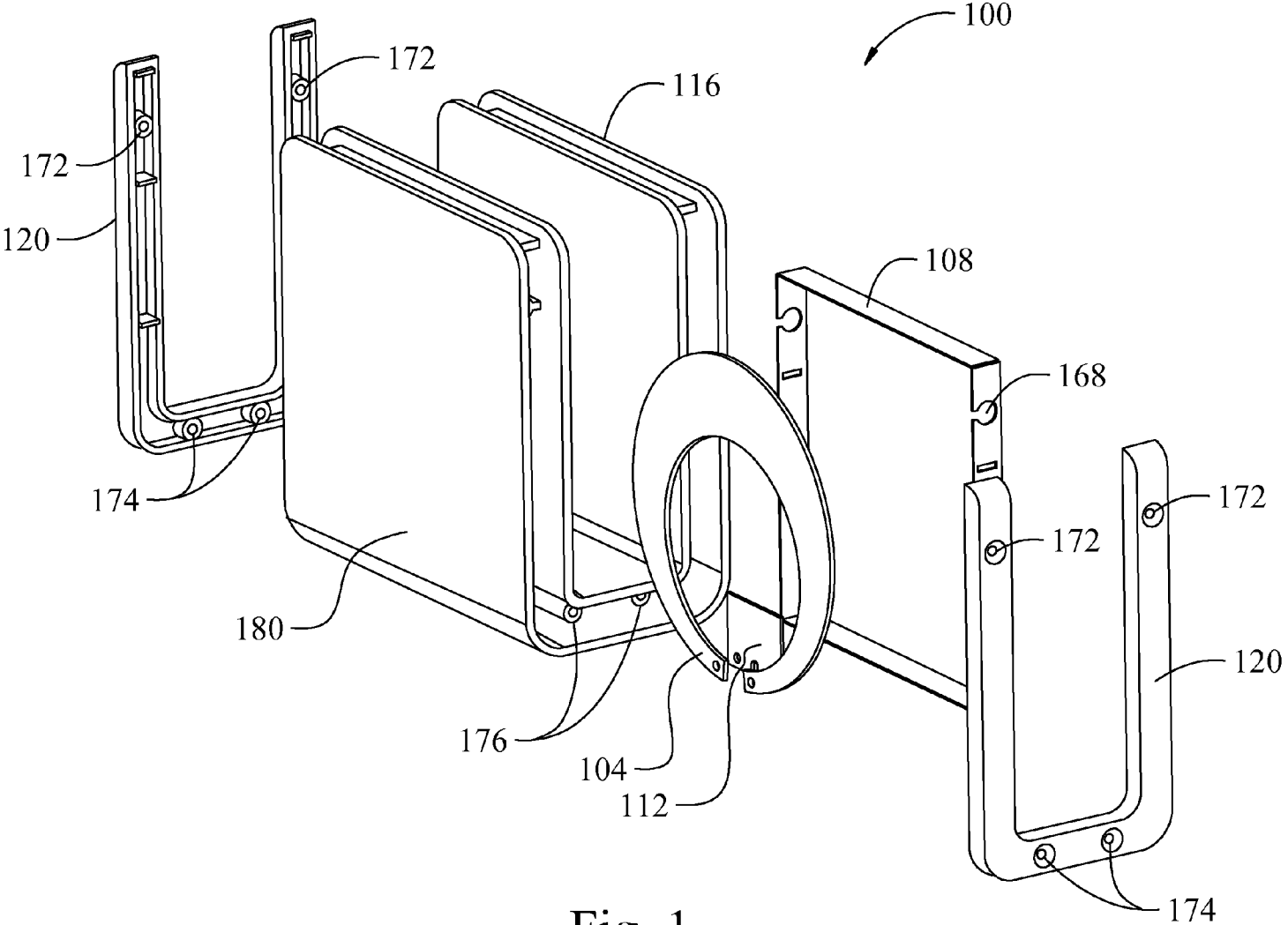
FIG. 1 is an exploded perspective view of an antenna assembly including a tapered loop antenna element, a reflector, a housing (with the end pieces exploded away for clarity), and a PCB balun according to an exemplary embodiment.

FIGS. 1 through 4 illustrate an exemplary antenna assembly 100 embodying one or more aspects of the present disclosure. As shown in FIG. 1, the antenna assembly 100 generally includes a tapered loop antenna element 104 (also shown in FIGS. 5 through 10), a reflector element 108, a balun 112, and a housing 116 with removable end pieces or portions 120.

Figure 11:
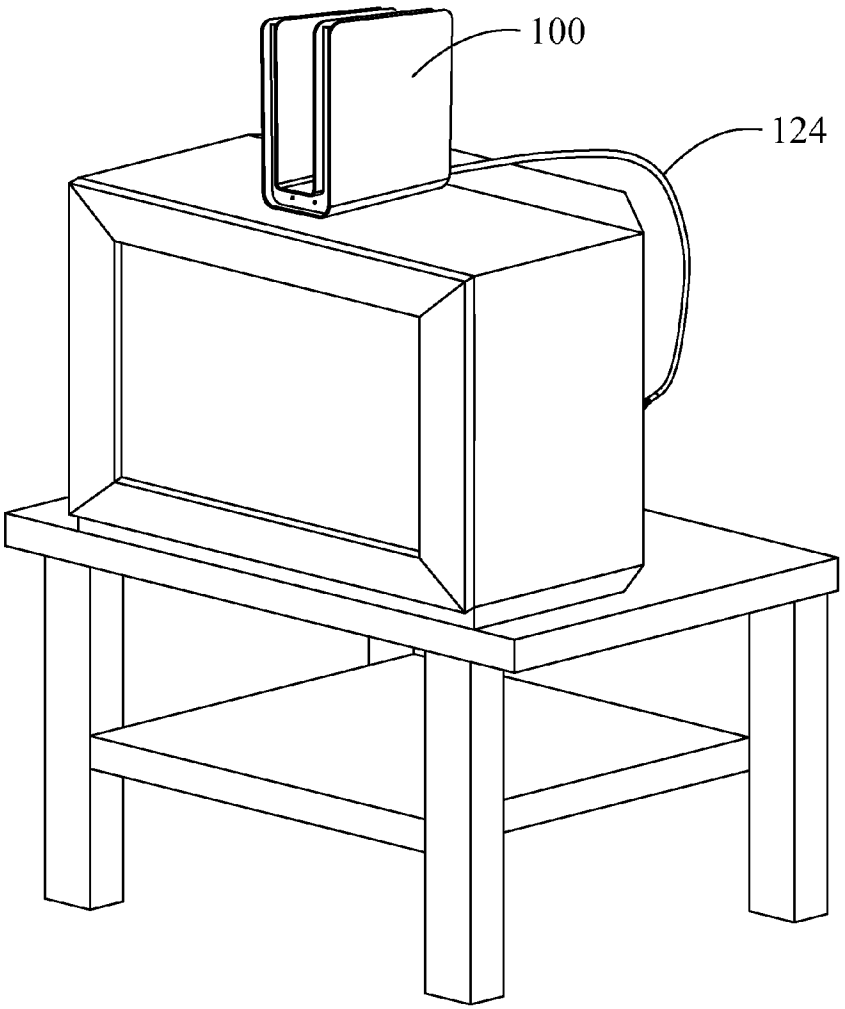
FIG. 11 is a perspective view illustrating an exemplary use for the antenna assembly shown in FIG. 2 with the antenna assembly supported on top of a television with a coaxial cable connecting the antenna assembly to the television, whereby the antenna assembly is operable for receiving signals and communicating the same to the television via the coaxial cable.

As shown in FIG. 11, the antenna assembly 100 may be used for receiving digital television signals (of which high definition television (HDTV) signals are a subset) and communicating the received signals to an external device, such as a television. In the illustrated embodiment, a coaxial cable 124 (FIGS. 2 and 11) is used for transmitting signals received by the antenna assembly 100 to the television (FIG. 11). The antenna assembly 100 may also be positioned on other generally horizontal surfaces, such as a tabletop, coffee tabletop, desktop, shelf, etc.). Alternative embodiments may include an antenna assembly positioned elsewhere and/or supported using other means.

In one example, the antenna assembly 100 may include a 75-ohm RG6 coaxial cable 124 fitted with an F-Type connector (although other suitable communication links may also be employed). Alternative embodiments may include other coaxial cables or other suitable communication links.

Figure 3:
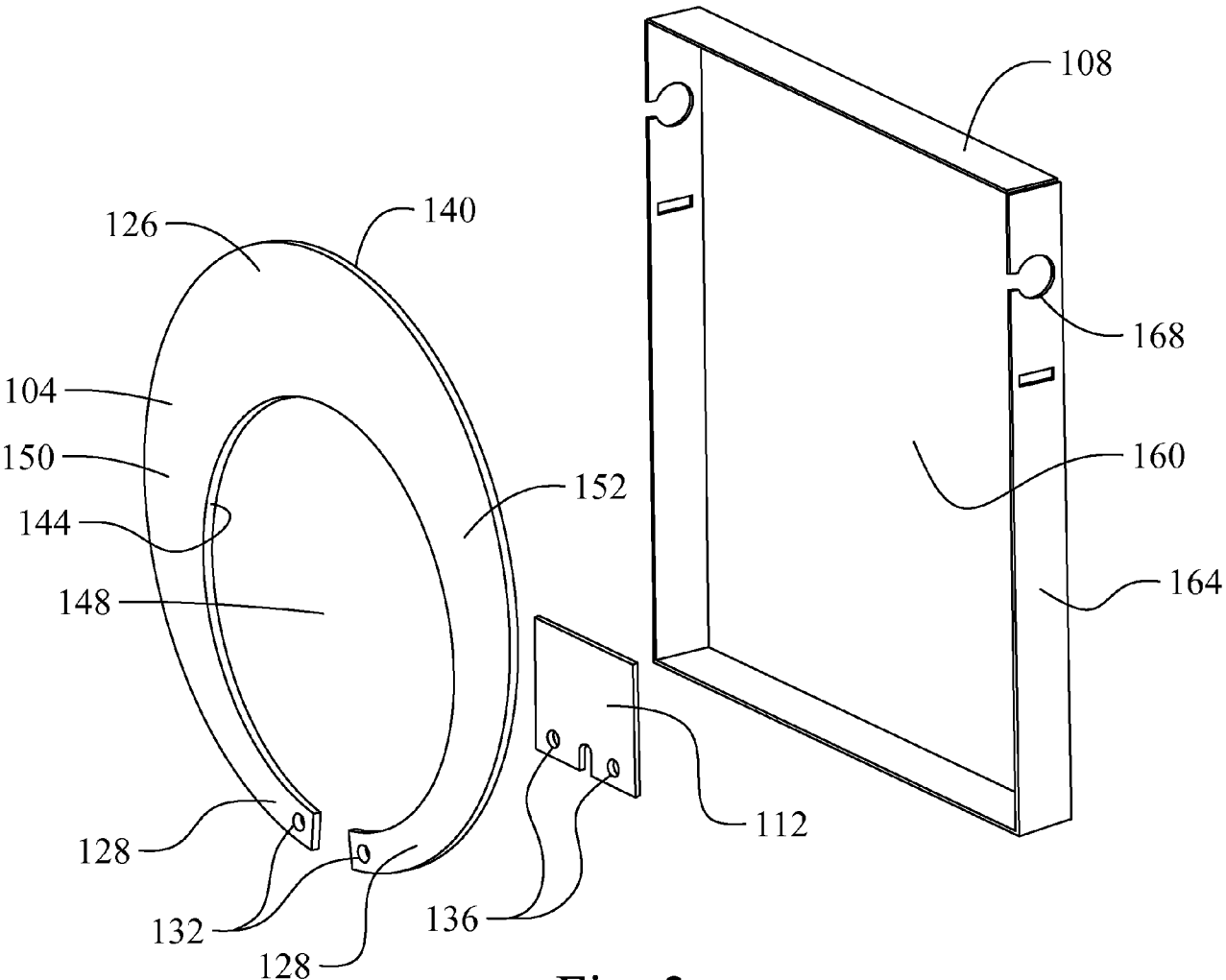
FIG. 3 is an end perspective view illustrating the tapered loop antenna element, reflector, and PCB balun shown in FIG. 1.
Figure 5:
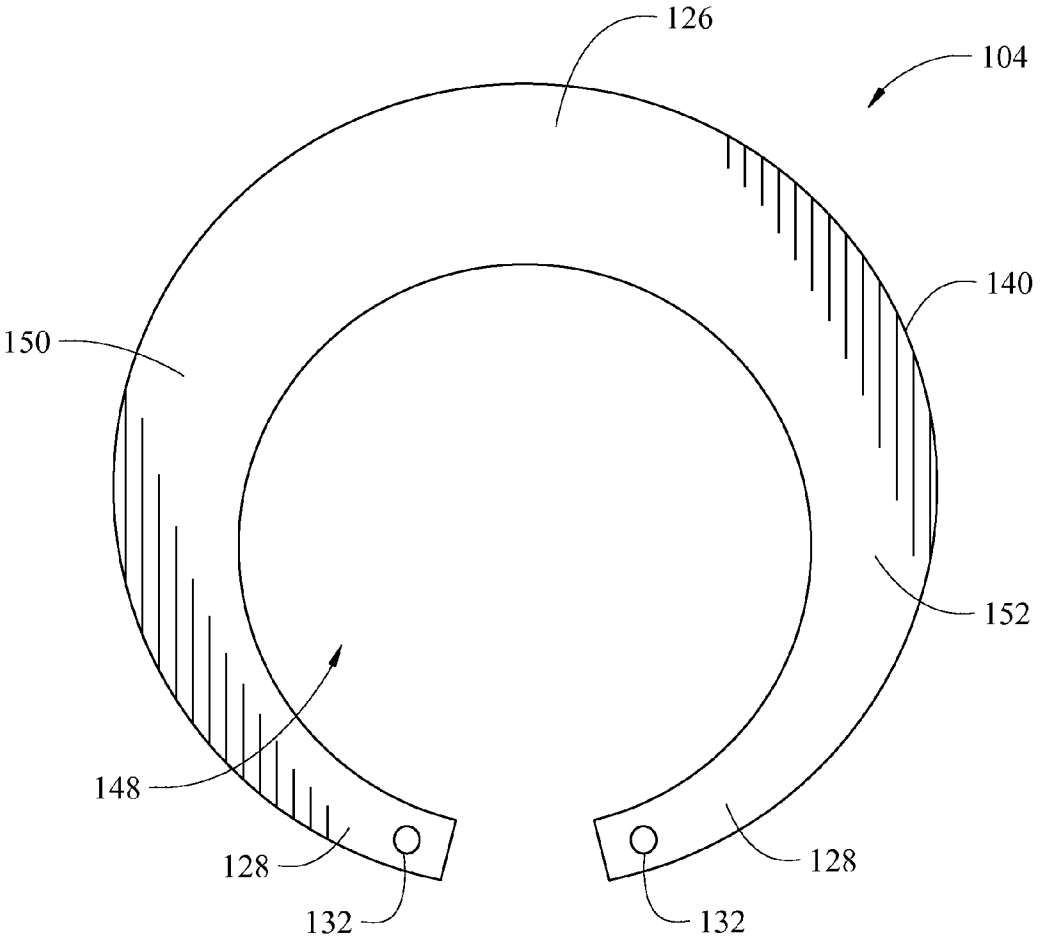
FIG. 5 is a front elevation view of the tapered loop antenna element shown in FIG. 1.
Figure 6:
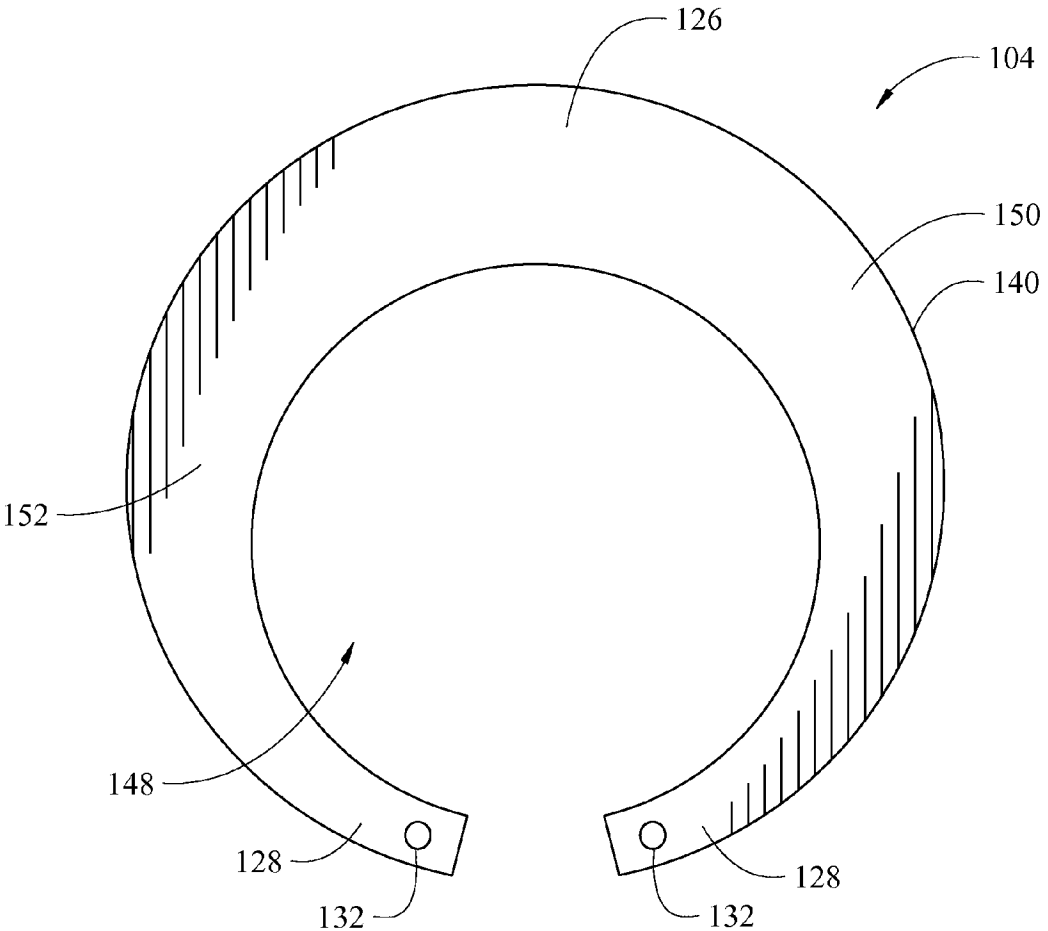
FIG. 6 is a back elevation of the tapered loop antenna element shown in FIG. 1.
Figure 7:
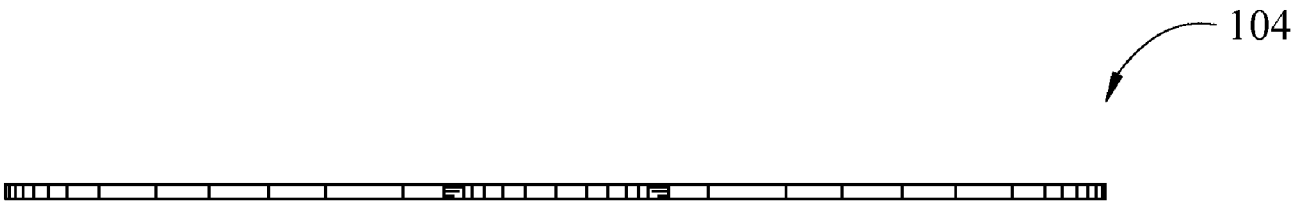
FIG. 7 is a bottom plan view of the tapered loop antenna element shown in FIG. 1.
Figure 8:
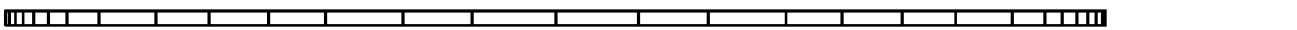
FIG. 8 is a top plan view of the tapered loop antenna element shown in FIG. 1.
Figure 10:
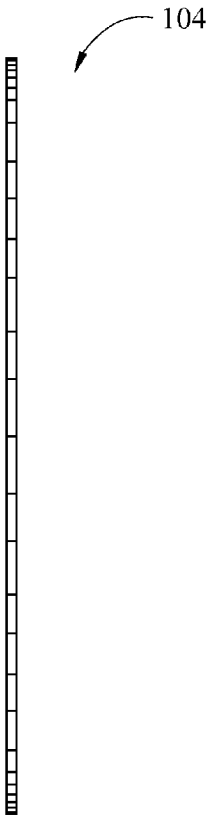
FIG. 10 is a left elevation view of the tapered loop antenna element shown in FIG. 1.
Figure 9:
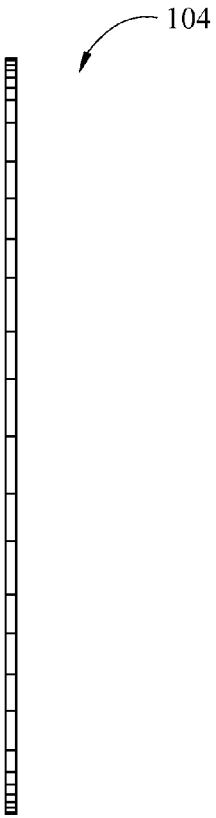
FIG. 9 is a right elevation view of the tapered loop antenna element shown in FIG. 1.

As shown in FIGS. 3, 5, and 6, the tapered loop antenna element 104 has a generally annular shape cooperatively defined by an outer periphery or perimeter portion 140 and an inner periphery or perimeter portion 144. The outer periphery or perimeter portion 140 is generally circular. The inner periphery or perimeter portion 144 is also generally circular, such that the tapered loop antenna element 104 has a generally circular opening 148.

In some embodiments, the tapered loop antenna element has an outer diameter of about two hundred twenty millimeters and an inner diameter of about eighty millimeters. Some embodiments include the inner diameter being offset from the outer diameter such that the center of the circle defined generally by the inner perimeter portion 144 (the inner diameter's midpoint) is about twenty millimeters below the center of the circle defined generally by the outer perimeter portion 140 (the outer diameter's midpoint). Stated differently, the inner diameter may be offset from the outer diameter such that the inner diameter's midpoint is about twenty millimeters below the outer diameter's midpoint. The offsetting of the diameters thus provides a taper to the tapered loop antenna element 104 such that it has at least one portion (a top portion 126 shown in FIGS. 3, 5, and 6) wider than another portion (the end portions 128 shown in FIGS. 3, 5, and 6). The taper of the tapered loop antenna element 104 has been found to improve performance and aesthetics. As shown by FIGS. 1, 3, 5, and 6, the tapered loop antenna element 104 includes first and second halves or curved portions 150, 152 that are generally symmetric such that the first half or curved portion 150 is a mirror-image of the second half or curved portion 152. Each curved portion 150, 152 extends generally between a corresponding end portion 128 and then tapers or gradually increases in width until the middle or top portion 126 of the tapered loop antenna element 104. The tapered loop antenna element 104 may be positioned with the housing 116 in an orientation such that the wider portion 126 of the tapered loop antenna element 104 is at the top and the narrower end portions 128 are at the bottom.

With continued reference to FIGS. 3, 5, and 6, the tapered loop antenna element 104 includes spaced-apart end portions 128. In one particular example, the end portions 128 of the tapered loop antenna element 104 are spaced apart a distance of about 2.5 millimeters. Alternative embodiments may include an antenna element with end portions spaced apart greater than or less than 2.5 millimeters. For example, some embodiments include an antenna element with end portions spaced apart a distance of between about 2 millimeters to about 5 millimeters. The spaced-apart end portions may define an open slot therebetween that is operable to provide a gap feed for use with a balanced transmission line.

The end portions 128 include fastener holes 132 in a pattern corresponding to fastener holes 136 of the PCB balun 112. Accordingly, mechanical fasteners (e.g., screws, etc.) may be inserted through the fastener holes 132, 136 after they are aligned, for attaching the PCB balun 112 to the tapered loop antenna element 104. Alternative embodiments may have differently configured fastener holes (e.g., more or less, different shapes, different sizes, different locations, etc.). Still other embodiments may include other attachment methods (e.g., soldering, etc.).

As shown in FIGS. 4 and 7-10, the illustrated tapered loop antenna element 104 is substantially planar with a generally constant or uniform thickness. In one exemplary embodiment, the tapered loop antenna element 104 has a thickness of about 3 millimeters. Other embodiments may include a thicker or thinner antenna element. For example, some embodiments may include an antenna element with a thickness of about 35 micrometers (e.g., 1 oz copper, etc.), where the antenna element is mounted, supported, or installed on a printed circuit board. Further embodiments may include a free-standing, self-supporting antenna element made from aluminum, copper, etc. having a thickness between about 0.5 millimeters to about 5 millimeters, etc. In another exemplary embodiment, the antenna element comprises a relatively thin aluminum foil that is encased in a supporting plastic enclosure, which has been used to reduce material costs associated with the aluminum.

Alternative embodiments may include an antenna element that is configured differently than the tapered loop antenna element 104 shown in the figures. For example, other embodiments may include a non-tapered loop antenna element having a centered (not offset) opening. Additional embodiments may include a loop antenna element that defines a full generally circular loop or hoop without spaced-apart free end portions 128. Further embodiments may include an antenna element having an outer periphery/perimeter portion, inner periphery/perimeter portion, and/or opening sized or shaped differently, such as with a non-circular shape (e.g., ovular, triangular, rectangular, etc.). The antenna element 104 (or any portion thereof) may also be provided in various configurations (e.g., shapes, sizes, etc.) depending at least in part on the intended end-use and signals to be received by the antenna assembly.

A wide range of materials may be used for the antenna element 104. By way of example only, the tapered loop antenna element 104 may be formed from a metallic electrical conductor, such as aluminum, copper, stainless steel or other alloys, etc. In another embodiment, the tapered loop antenna element 104 may be stamped from sheet metal, or created by selective etching of a copper layer on a printed circuit board substrate.

Figure 4:
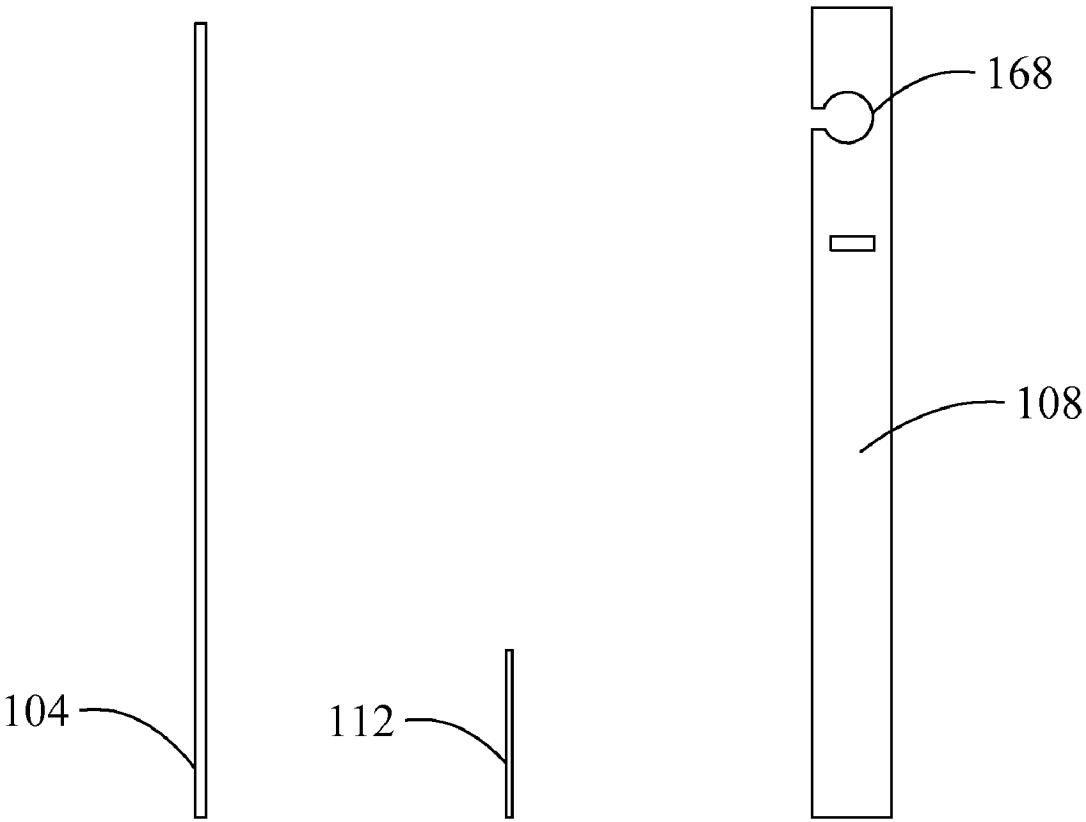
FIG. 4 is a side elevation view of the components shown in FIG. 3.

FIGS. 1, 3, and 4 illustrate the exemplary reflector 108 that may be used with the antenna assembly 100. As shown in FIG. 3, the reflector 108 includes a generally flat or planar surface 160. The reflector 108 also includes baffle, lip, or sidewall portions 164 extending outwardly relative to the surface 160. The reflector 108 may be generally operable for reflecting electromagnetic waves generally towards the tapered loop antenna element 104.

In regard to the size of the reflector and the spacing to the antenna element, the inventors hereof note the following. The size of the reflector and the spacing to the antenna element strongly impact performance. Placing the antenna element too close to the reflector provides an antenna with good gain, but narrows impedance bandwidth and poor VSWR (voltage standing wave ratio). Despite the reduced size, such designs are not suitable for the intended broadband application. If the antenna element is placed too far away from the reflector, the gain is reduced due to improper phasing. When the antenna element size and proportions, reflector size, baffle size, and spacing between antenna element and reflector are properly chosen, there is an optimum configuration that takes advantage of the near zone coupling with the electrically small reflector element to produce enhanced impedance bandwidth, while mitigating the effects of phase cancellation. The net result is an exemplary balance between impedance bandwidth, directivity or gain, radiation efficiency, and physical size.

In this illustrated embodiment, the reflector 108 is generally square with four perimeter sidewall portions 164. Alternative embodiments may include a reflector with a different configuration (e.g., differently shaped, sized, less sidewall portions, etc.). The sidewalls may even be reversed so as to point opposite the antenna element. The contribution of the sidewalls is to slightly increase the effective electrical size of the reflector and improve impedance bandwidth.

Dimensionally, the reflector 108 of one exemplary embodiment has a generally square surface 160 with a length and width of about 228 millimeters. Continuing with this example, the reflector 108 may also have perimeter sidewall portions 164 each with a height of about 25.4 millimeters relative to the surface 160. The dimensions provided in this paragraph (as are all dimensions set forth herein) are mere examples provided for purposes of illustration only, as any of the disclosed antenna components herein may be configured with different dimensions depending, for example, on the particular application and/or signals to be received or transmitted by the antenna assembly. For example, another embodiment may include a reflector 108 having a baffle, lip, or perimeter sidewall portions 164 having a height of about ten millimeters. Another embodiment may have the reflector 108 having a baffle, lip in the opposite direction to the antenna element. In such embodiment, it is possible to also add a top to the open box, which may serve as a shielding enclosure for a receiver board or other electronics.

With further reference to FIG. 3, cutouts, openings, or notches 168 may be provided in the reflector's perimeter sidewall portions 164 to facilitate mounting of the reflector 108 within the housing 116 and/or attachment of the housing end pieces 120. In an exemplary embodiment, the reflector 108 may be slidably positioned within the housing 116 (FIG. 1). The fastener holes 172 of the housing end pieces 120 may be aligned with the reflector's openings 168, such that fasteners may be inserted through the aligned openings 168, 172. Alternative embodiments may have reflectors without such openings, cutouts, or notches.

FIGS. 1, 3, and 4 illustrate an exemplary balun 112 that may be used with the antenna assembly 100 for converting a balanced line into an unbalanced line. In the illustrated embodiment, the antenna assembly 100 includes a printed circuit board having the balun 112. The PCB having the balun 112 may be coupled to the tapered loop antenna element 104 via fasteners and fastener holes 132 and 136 (FIG. 3). Alternative embodiments may include different means for connecting the balun 112 to the tapered loop antenna elements and/or different types of transformers besides the printed circuit board balun 112.

As shown in FIG. 1, the housing 116 includes end pieces 120 and a middle portion 180. In this particular example, the end pieces 120 are removably attached to middle portion 180 by way of mechanical fasteners, fastener holes 172, 174, and threaded sockets 176. Alternative embodiments may include a housing with an integrally-formed, fixed end piece. Other embodiments may include a housing with one or more removable end pieces that are snap-fit, friction fit, or interference fit with the housing middle portion without requiring mechanical fasteners.

Figure 2:
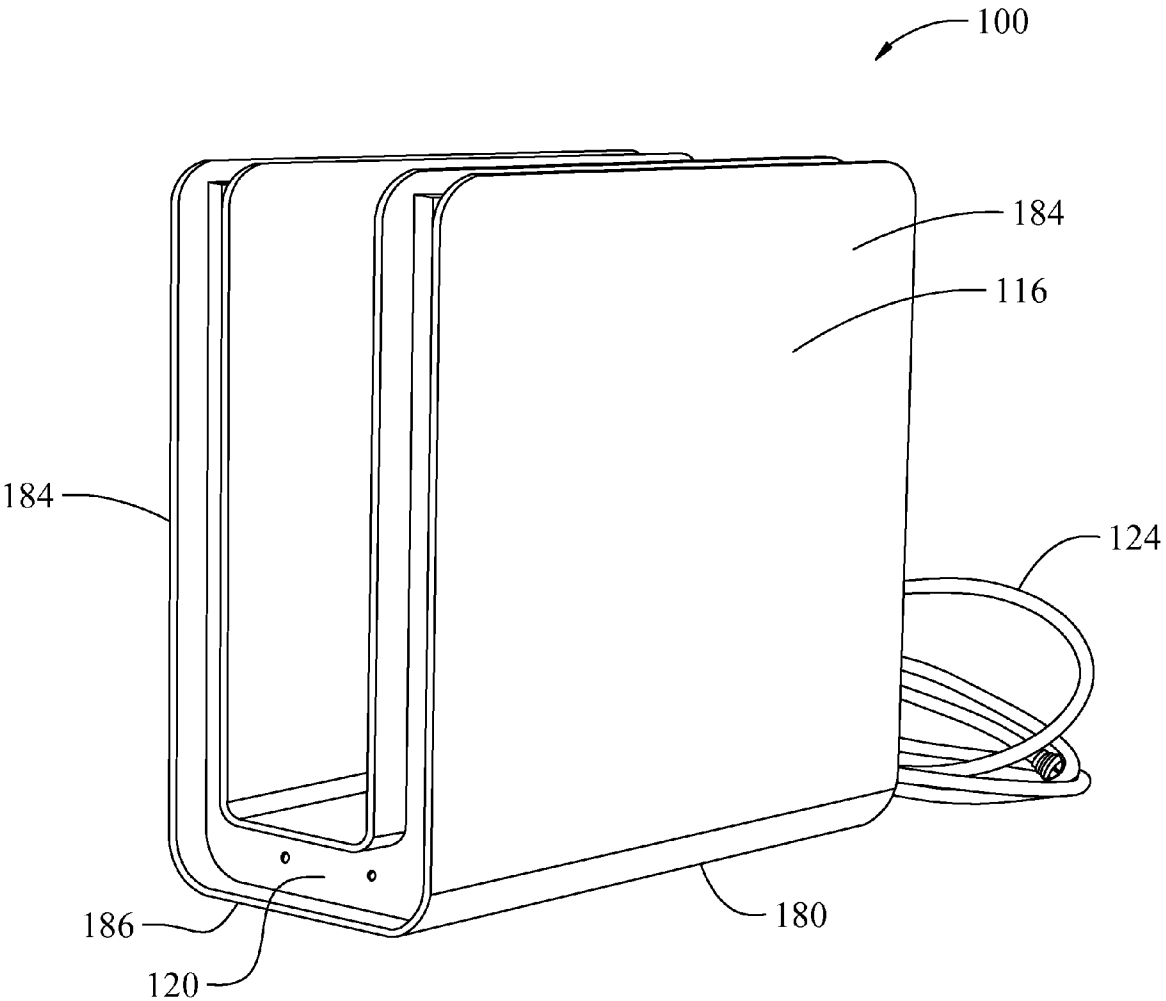
FIG. 2 is a perspective view illustrating the antenna assembly shown in FIG. 1 after the components have been assembled and enclosed within the housing.

As shown in FIG. 2, the housing 116 is generally U-shaped with two spaced-apart upstanding portions or members 184 connected by a generally horizontal member or portion 186. The members 184, 186 cooperatively define a generally U-shaped profile for the housing 116 in this embodiment.

As shown by FIG. 1, the tapered loop antenna element 104 may be positioned in a different upstanding member 184 than the upstanding member 184 in which the reflector 108 is positioned. In one particular example, the housing 116 is configured (e.g., shaped, sized, etc.) such that the tapered loop antenna element 104 is spaced apart from the reflector 108 by about 114.4 millimeters when the tapered loop antenna element 104 and reflector 108 are positioned into the respective different sides of the housing 116. In addition, the housing 116 may be configured such that the housing's side portions 184 are generally square with a length and a width of about 25.4 centimeters. Accordingly, the antenna assembly 100 may thus be provided with a relatively small overall footprint. These shapes and dimensions are provided for purposes of illustration only, as the specific configuration (e.g., shape, size, etc.) of the housing may be changed depending, for example, on the particular application.

The housing 116 may be formed from various materials. In some embodiments, the housing 116 is formed from plastic. In those embodiments in which the antenna assembly is intended for use as an outdoor antenna, the housing may be formed from a weather resistant material (e.g., waterproof and/or ultra-violet resistant material, etc.). In addition, the housing 116 (or bottom portion thereof) may also be formed from a material so as to provide the bottom surface of the housing 116 with a relatively high coefficient of friction. This, in turn, would help the antenna assembly 100 resist sliding relative to the surface (e.g., top surface of television as shown in FIG. 11, etc.) supporting the assembly 100.

In some embodiments, the antenna assembly may also include a digital tuner/converter (ATSC receiver) built into or within the housing. In these exemplary embodiments, the digital tuner/converter may be operable for converting digital signals received by the antenna assembly to analog signals. In one exemplary example, a reflector with a reversed baffle and cover may serve as a shielded enclosure for the ATSC receiver. The shielded box reduces the effects of radiated or received interference upon the tuner circuitry. Placing the tuner in this enclosure conserves space and eliminates (or reduces) the potential for coupling between the antenna element and the tuner, which may otherwise negatively impact antenna impedance bandwidth and directivity.

In various embodiments, the antenna assembly 100 is tuned (and optimized in some embodiments) to receive signals having a frequency associated with high definition television (HDTV) within a frequency range of about 470 megahertz and about 690 megahertz. In such embodiments, narrowly tuning the antenna assembly 100 for receiving these HDTV signals allows the antenna element 104 to be smaller and yet still function adequately. With its smaller discrete physical size, the overall size of the antenna assembly 100 may be reduced so as to provide a reduced footprint for the antenna assembly 100, which may, for example, be advantageous when the antenna assembly 100 is used indoors and placed on top of a television (e.g., FIG. 11, etc.).

Exemplary operational parameters of the antenna assembly 100 will now be provided for purposes of illustration only. These operational parameters may be changed for other embodiments depending, for example, on the particular application and signals to be received by the antenna assembly.

Figure 12:
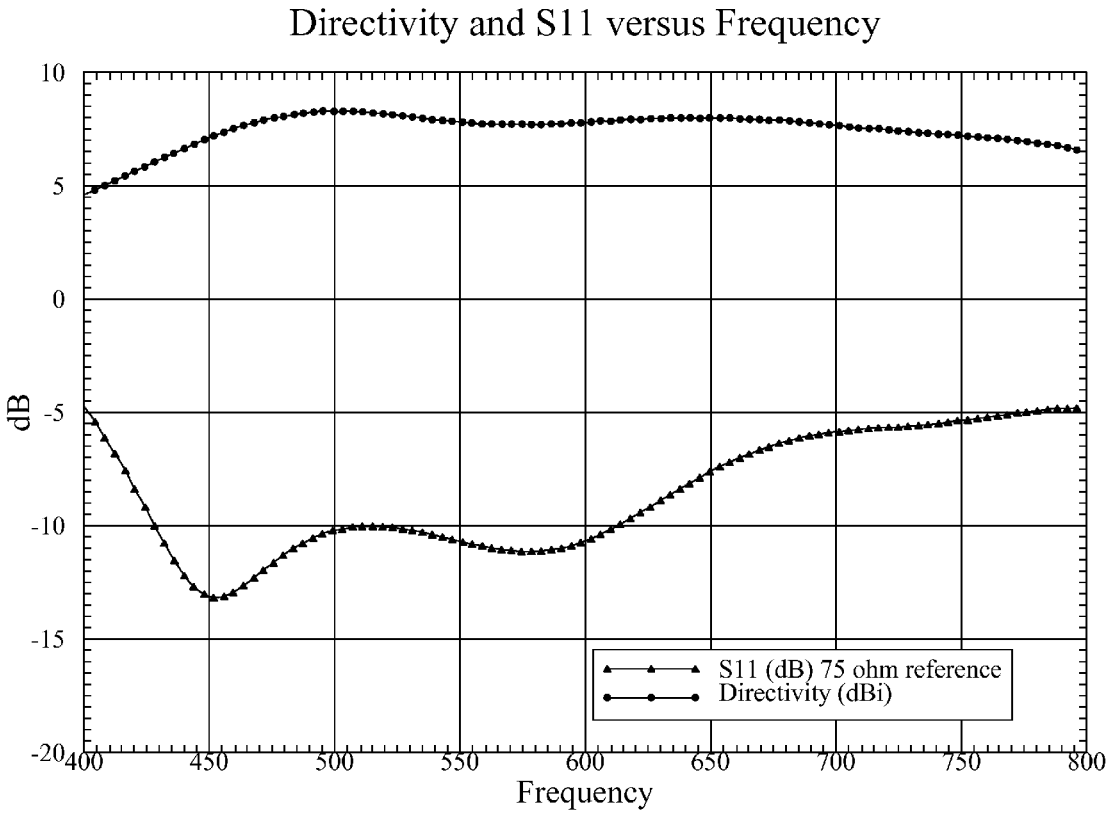
FIG. 12 is an exemplary line graph showing computer-simulated gain/directivity and S11 versus frequency (in megahertz) for an exemplary embodiment of the antenna assembly with seventy-five ohm unbalanced coaxial feed.

In some embodiments, the antenna assembly 100 may be configured so as to have operational parameters substantially as shown in FIG. 12, which illustrates computer-simulated gain/directivity and S11 versus frequency (in megahertz) for an exemplary embodiment of the antenna assembly 100 with seventy-five ohm unbalanced coaxial feed. In other embodiments, a 300 ohm balanced twin lead may be used.

FIG. 12 generally shows that the antenna assembly 100 has a relatively flat gain curve from about 470 MHz to about 698

MHz. In addition, FIG. 12 also shows that the antenna assembly 100 has a maximum gain of about 8 dBi (decibels referenced to isotropic gain) and an output with an impedance of about 75 Ohms.

In addition, FIG. 12 also shows that the S11 is below −6 dB across the frequency band from about 470 MHz to about 698 MHz. Values of S11 below this value ensure that the antenna is well matched and operates with high efficiency.

In addition, an antenna assembly may also be configured with fairly forgiving aiming. In such exemplary embodiments, the antenna assembly would thus not have to be re-aimed or redirected each time the television channel was changed.

Figure 13:
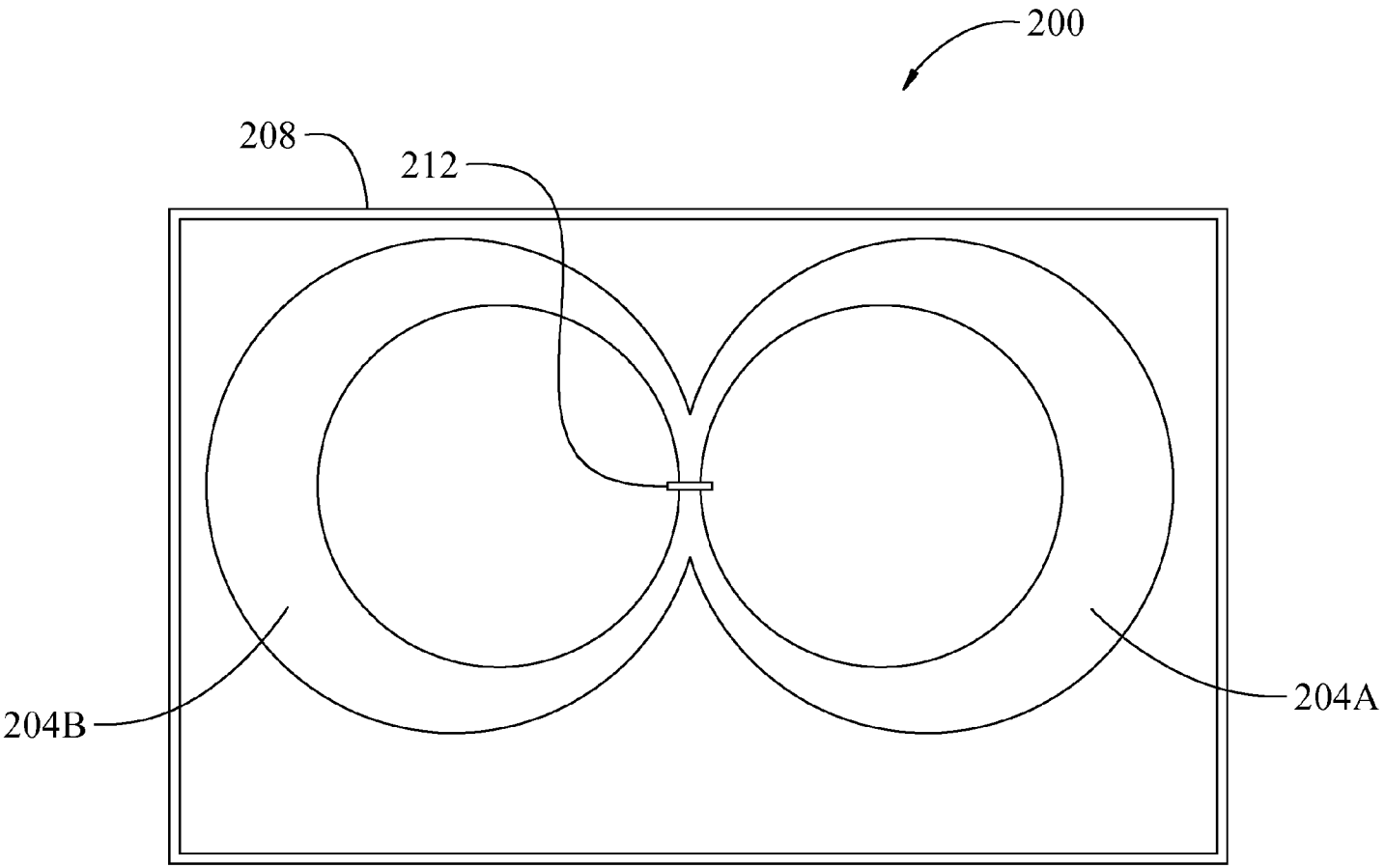
FIG. 13 is a view of another exemplary embodiment of an antenna assembly having two tapered loop antenna elements, a reflector, and a PCB balun.
Figure 20:
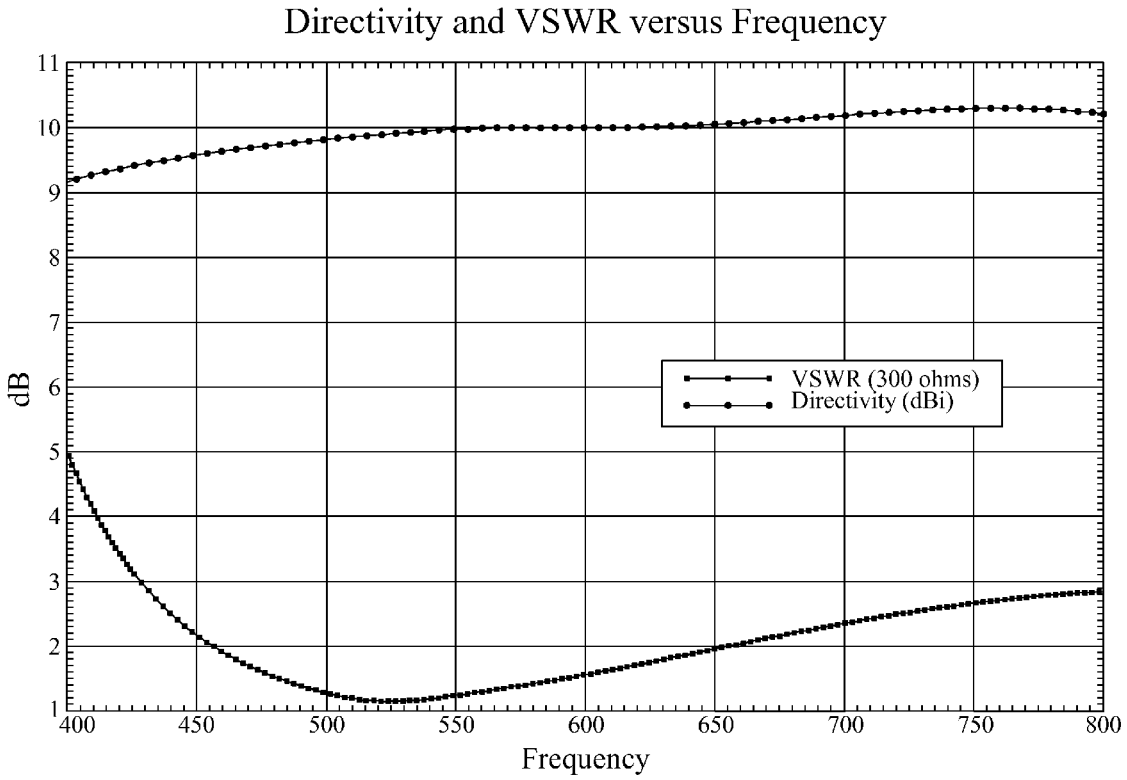
FIG. 20 is an exemplary line graph showing computer-simulated directivity and S11 versus frequency (in megahertz) for the antenna assembly shown in FIG. 13 according to an exemplary embodiment.
Figure 21:
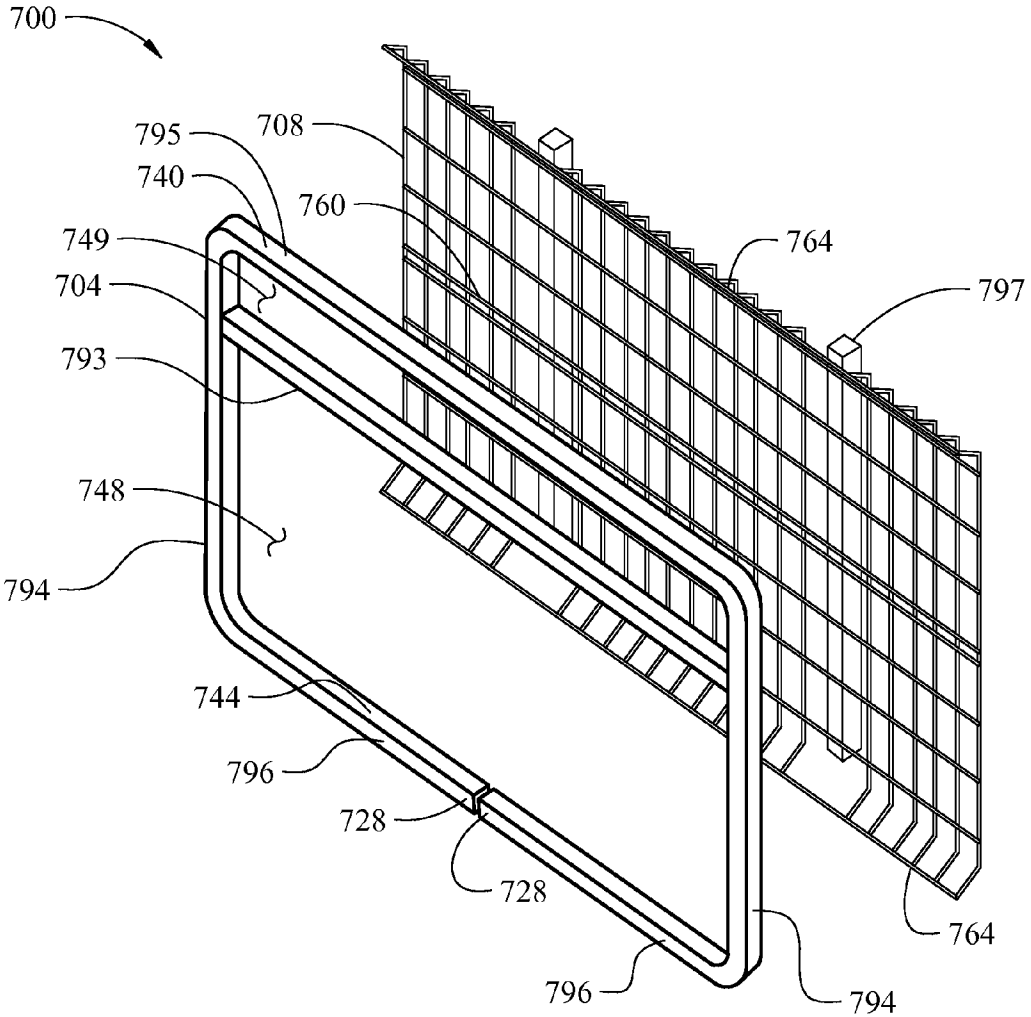
FIG. 21 is a perspective view of another exemplary embodiment of an antenna assembly configured for reception of VHF signals.
Figure 23:
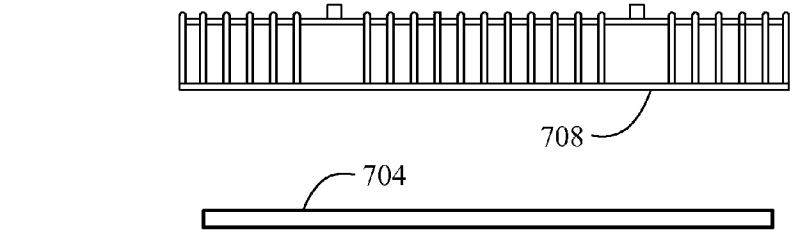
FIG. 23 is a top view of the antenna assembly shown in FIG. 21.
Figure 22:
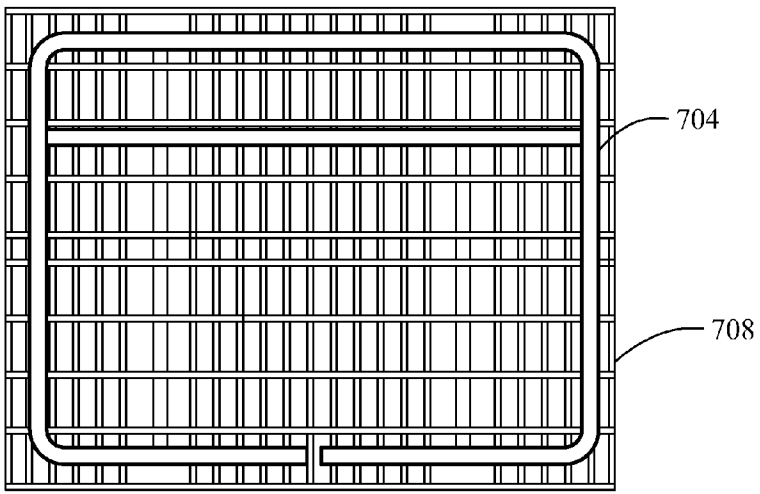
FIG. 22 is a front view of the antenna assembly shown in FIG. 21.
Figure 24:
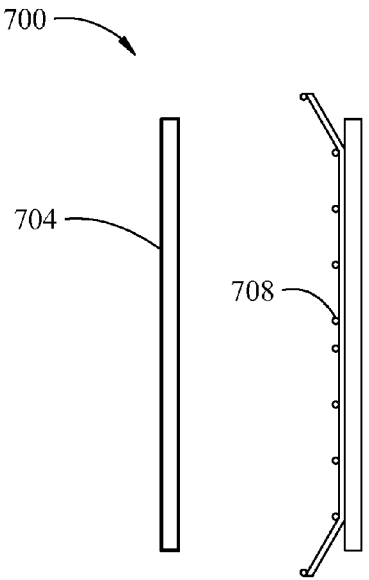
FIG. 24 is a side view of the antenna assembly shown in FIG. 21.

FIG. 13 illustrates another embodiment of an antenna assembly 200 embodying one or more aspects of the present disclosure. In this illustrated embodiment, the antenna assembly 200 includes two generally side-by-side tapered loop antenna elements 204A and 204B in a generally figure eight configuration (as shown in FIG. 13). The antenna assembly 200 also includes a reflector 208 and a printed circuit board balun 212. The antenna assembly 200 may be provided with a housing similar to or different than housing 116. Other than having two tapered loop antenna elements 204A, 204B (and improved antenna range that may be achieved thereby), the antenna assembly 200 may be operable and configured similar to the antenna assembly 100 in at least some embodiments thereof. FIG. 20 is an exemplary line graph showing computer-simulated directivity and S11 versus frequency (in megahertz) for the antenna assembly 200 according to an exemplary embodiment.

Figure 14:
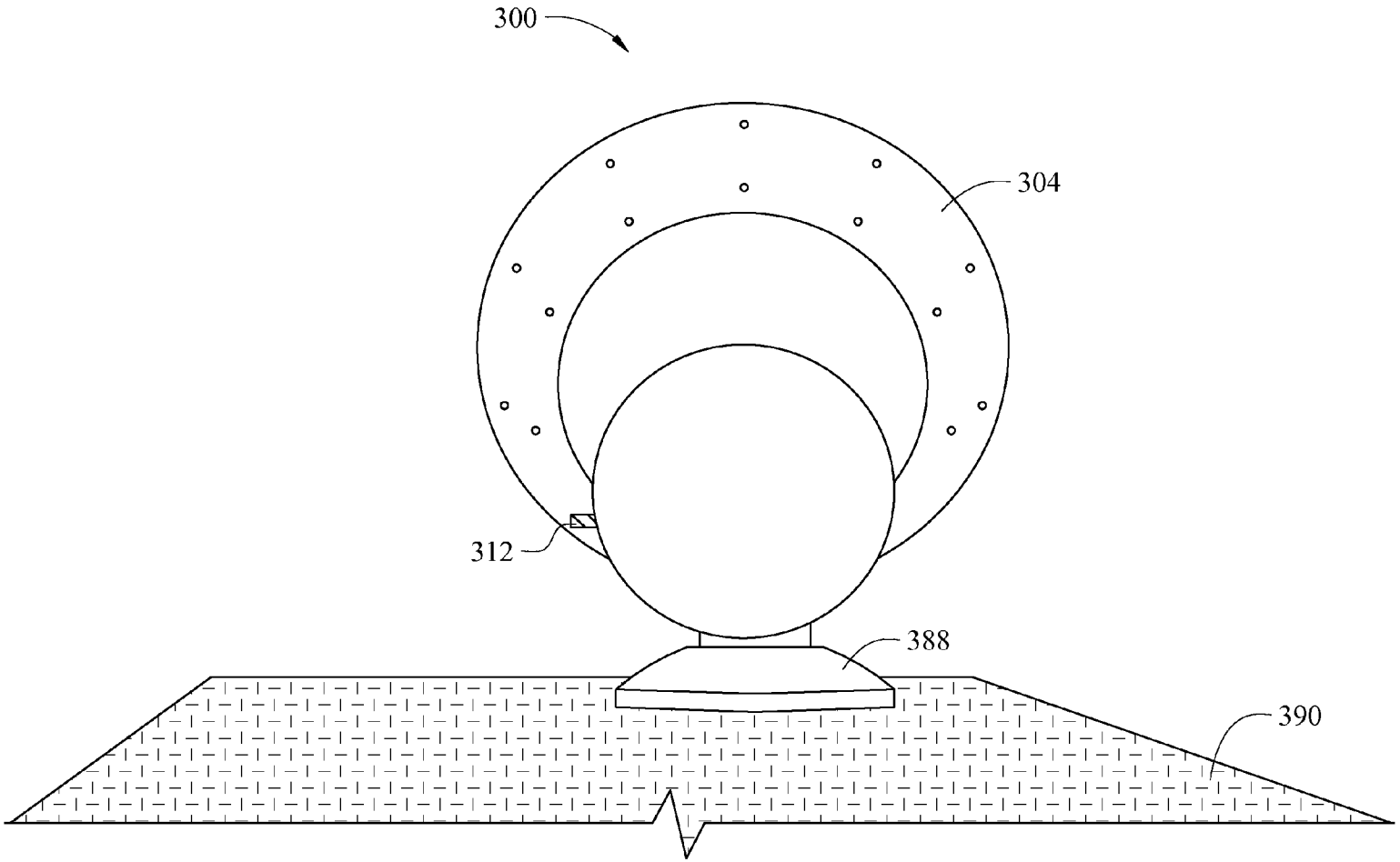
FIG. 14 is a view of another exemplary embodiment of an antenna assembly having a tapered loop antenna element and a support, and also showing the antenna assembly supported on top of a desk or table top.
Figure 15:
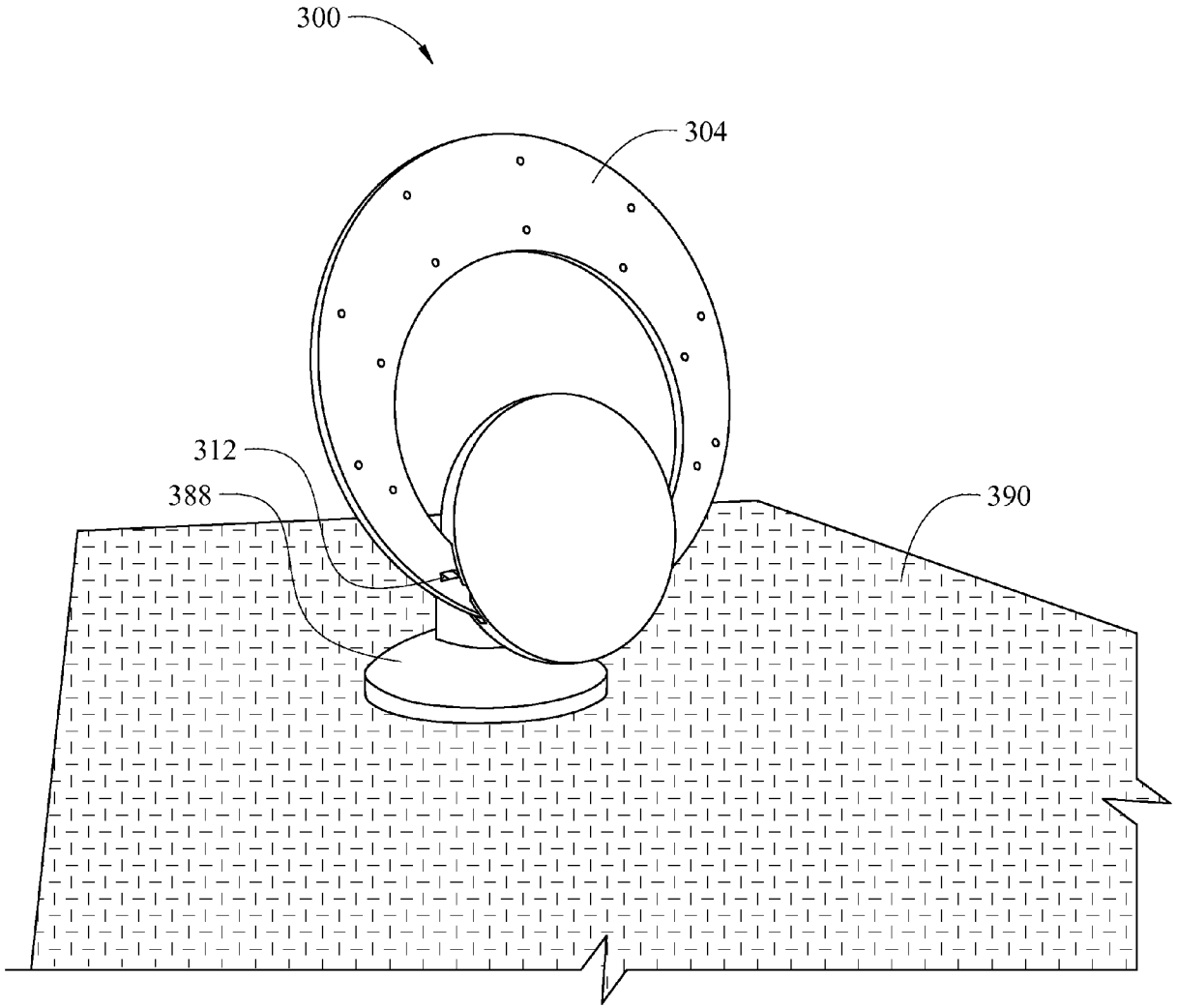
FIG. 15 is a perspective view of the antenna assembly shown in FIG. 14.

FIGS. 14 through 19 and 26 through 42 show additional exemplary embodiments of antenna assemblies embodying one or more aspects of the present disclosure. For example, FIGS. 14 and 15 show an antenna assembly 300 having a tapered loop antenna element 304 and a support 388. In this exemplary embodiment, the antenna assembly 300 is supported on a horizontal surface 390, such as the top surface of a desk, table top, television, etc. The antenna assembly 300 may also include a printed circuit board balun 312. In some embodiments, an antenna assembly may include a tapered loop antenna element (e.g., 304, 404, 504, etc.) with openings (e.g., holes, indents, recesses, voids, dimples, etc.) along the antenna element's middle portion and/or first and second curved portions, where the openings may be used, for example, to help align and/or retain the antenna element to a support. For example, a relatively thin metal antenna element with such openings may be supported by a plastic support structure that has protuberances, nubs, or protrusions that align with and are frictionally received within the openings of the antenna element, whereby the frictional engagement or snap fit helps retain the antenna element to the plastic support structure.

Figure 16:
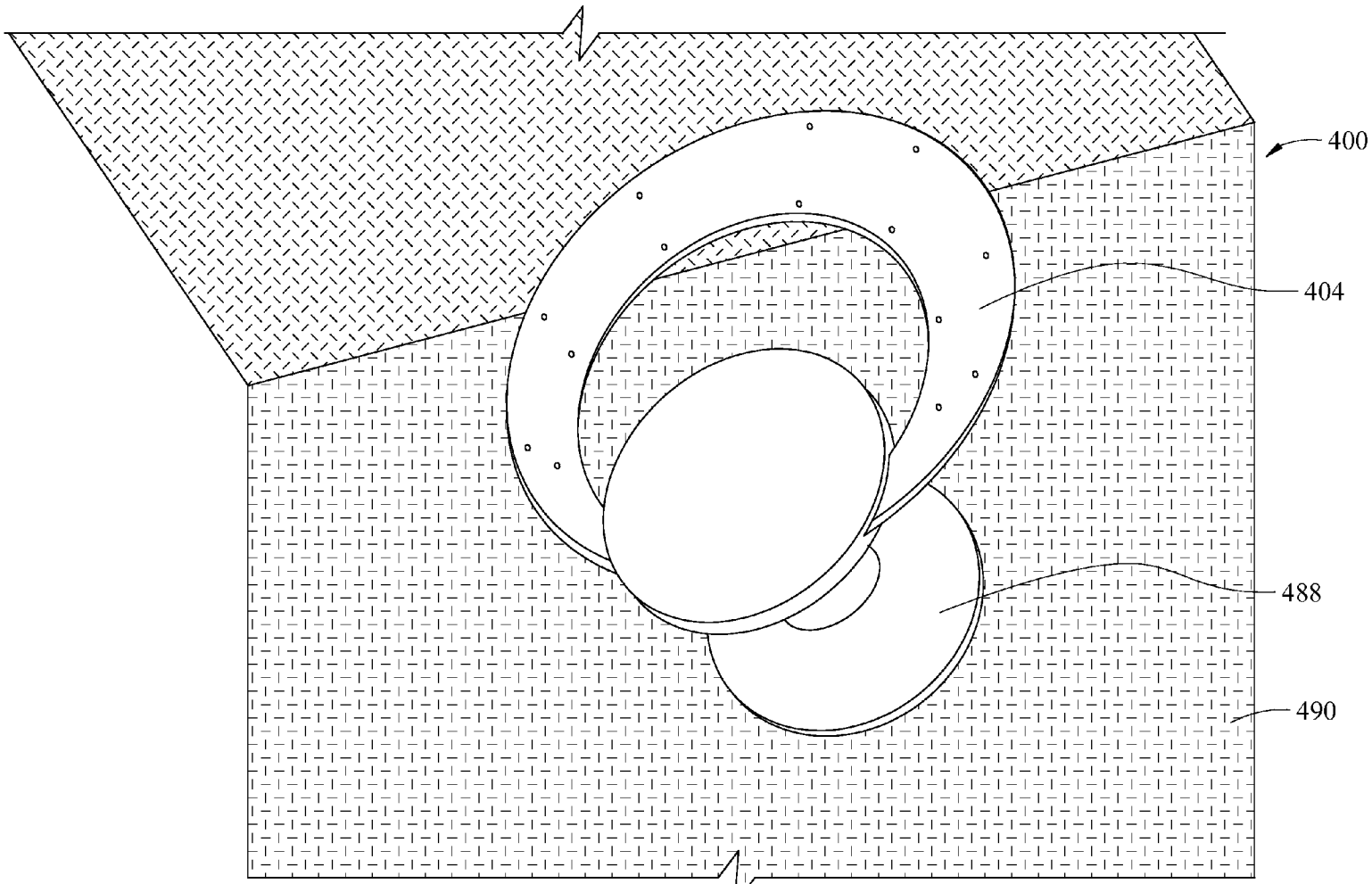
FIG. 16 is a perspective view of another exemplary embodiment of an antenna assembly having a tapered loop antenna element and an indoor wall mount/support, and also showing the antenna assembly mounted to a wall.

As another example, FIG. 16 shows an antenna assembly 400 having a tapered loop antenna element 404 and an indoor wall mount/support 488. In this example, the antenna assembly is mounted to a vertical surface 490, such a wall, etc. The antenna assembly 400 may also include a printed circuit board balun. The balun, however, is not illustrated in FIG. 10 because it is obscured by the support 488.

FIGS. 26 through 42 illustrate another exemplary antenna assembly 800 having a tapered lop antenna element 804 and a rotatably convertible support, mount, or stand 888. In this example, the tapered loop antenna 804 may be covered by or disposed within a cover material (e.g., plastic, other dielectric material, etc.), which may be the same material from which the support 888 is made.

Figure 26:
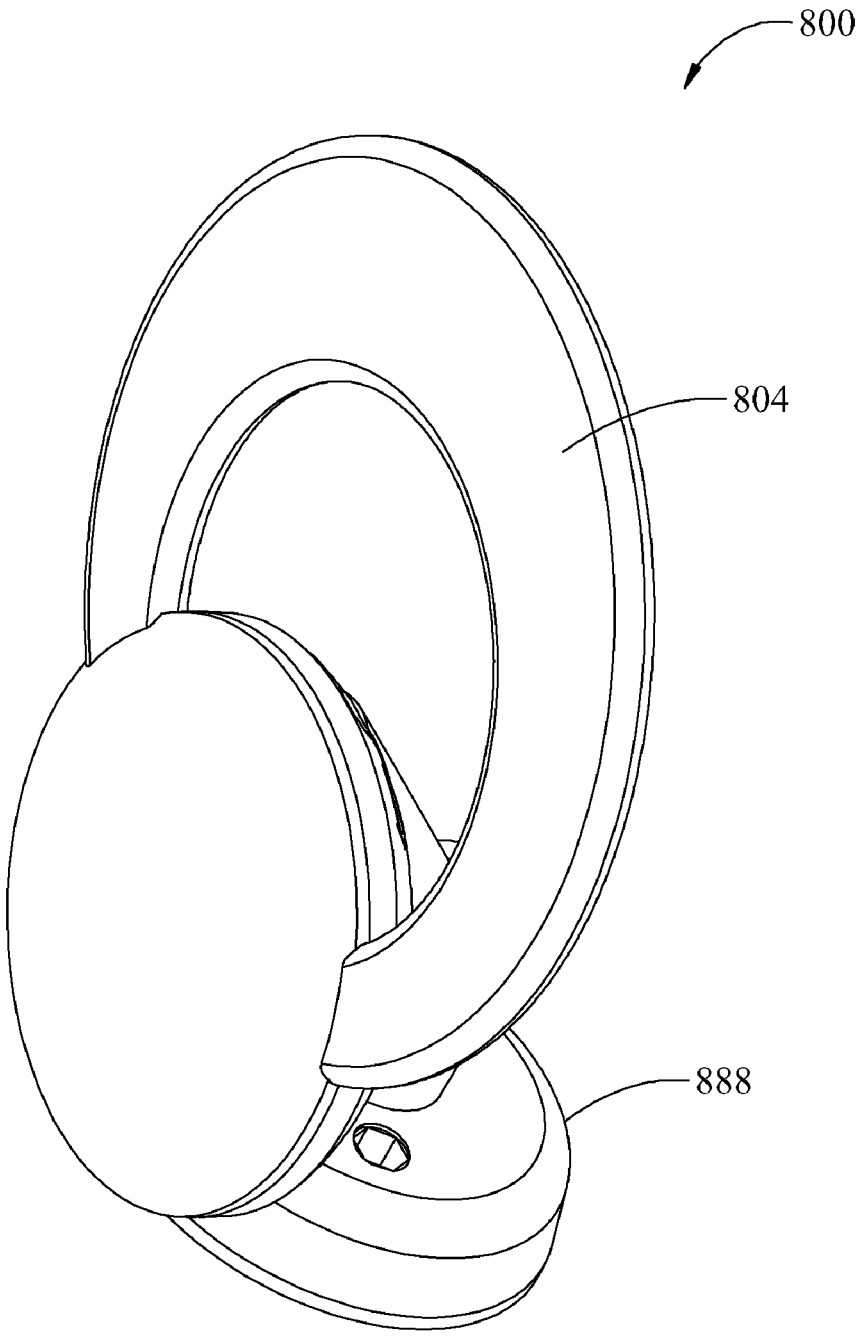
FIG. 26 is a perspective view of another exemplary embodiment of an antenna assembly having a tapered loop antenna element and a support that is rotatably convertible between a first configuration (shown in FIG. 26) for supporting the antenna assembly on a horizontal surface and a second configuration (shown in FIG. 27) for supporting the antenna assembly from a vertical surface.

In this example embodiment of the antenna assembly 800, the rotatably convertible support 888 allows the antenna assembly 800 to be supported on a horizontal surface from a vertical surface depending on whether the support 888 is in a first or second configuration. For example, FIG. 26 illustrates the support or stand 888 in a first configuration in which the support 888 allows the antenna assembly 800 to be supported on a horizontal surface after being placed upon that horizontal surface. The horizontal surface upon which the antenna assembly 800 may be placed may comprise virtually any horizontal surface, such as the top of a desk, table top, television, etc. In some embodiments, the antenna assembly 800 may be fixedly attached or fastened to the horizontal surface by using mechanical fasteners (e.g., wood screws, etc.) inserted through fastener holes 899 (FIG. 36) on the bottom of the support 888. But the antenna assembly 800 may be attached to a horizontal surface using other methods, such as double-side adhesive tape, etc. Or, the antenna assembly 800 need not be attached to the horizontal surface at all.

Figure 27:
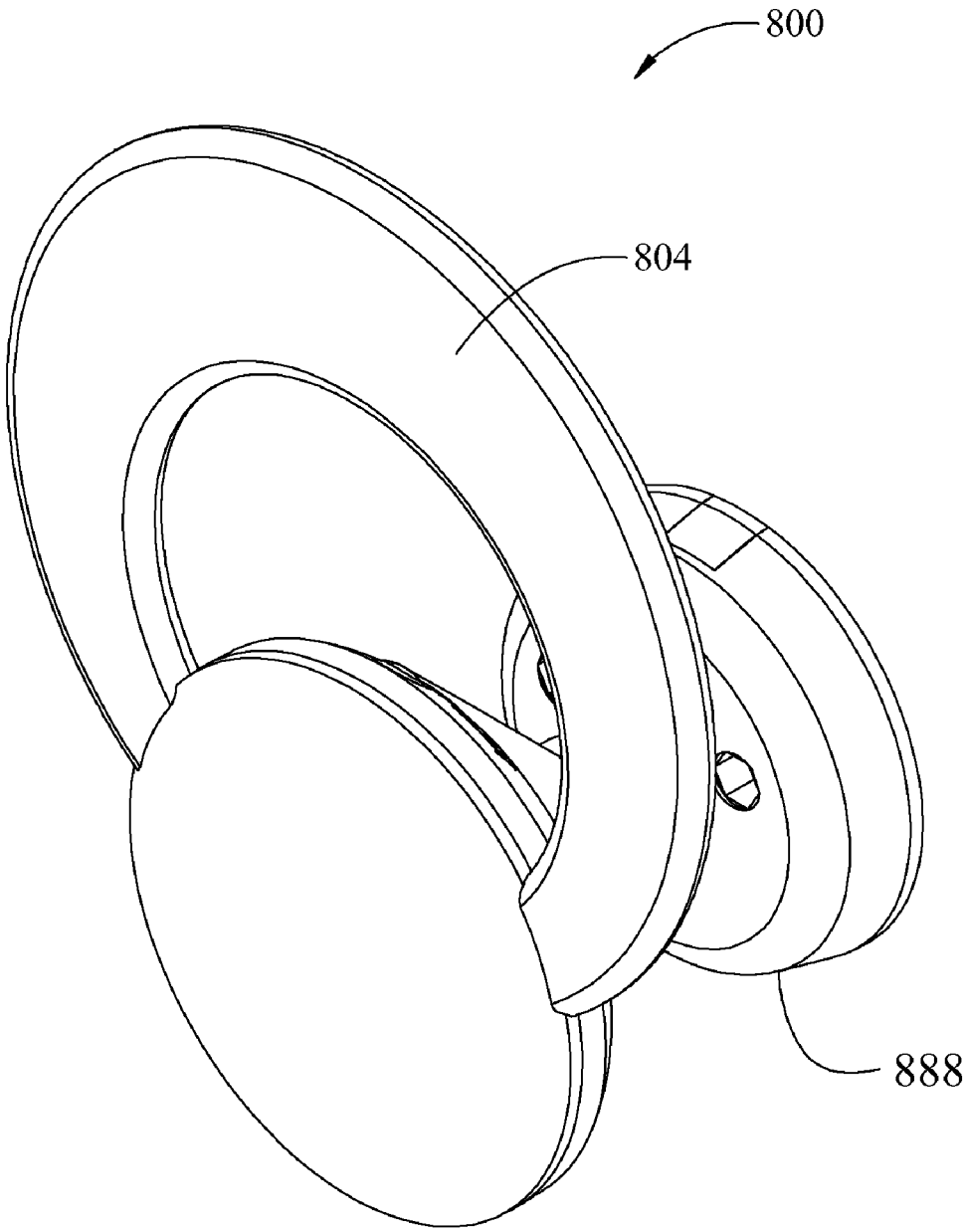
FIG. 27 is a perspective view of the antenna assembly shown in FIG. 26 but after the rotatably convertible support has been rotated to the second configuration for supporting the antenna assembly form a vertical surface.

FIG. 27 illustrates the support 888 in a second configuration that allows the antenna assembly 800 to be mounted to a vertical surface, such as wall, etc. In some embodiments, the antenna assembly 800 may be suspended from a nail or screw on a wall by way of the opening 898 (FIG. 40) on the bottom of the support 888.

Figure 28:
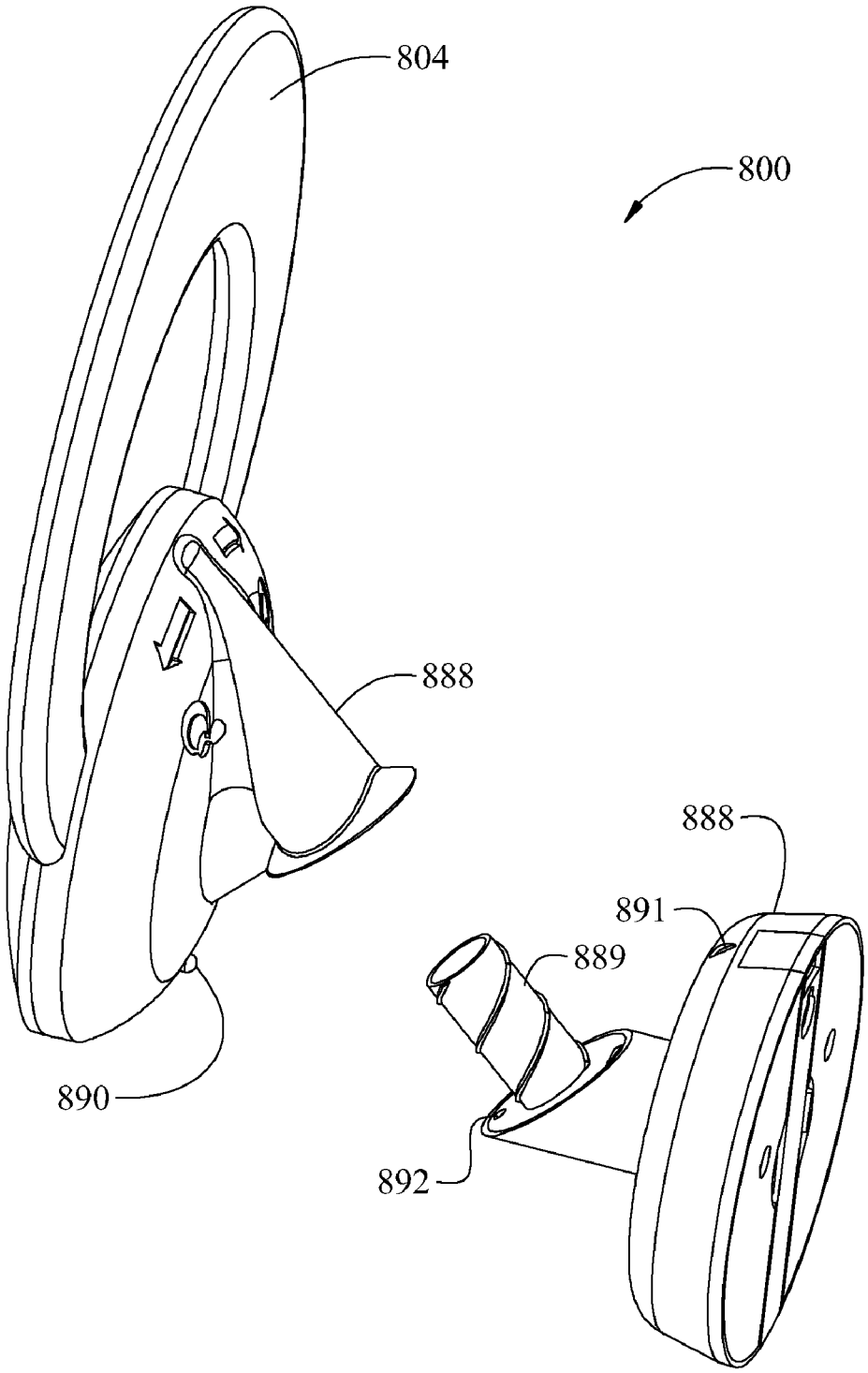
FIG. 28 is an exploded perspective view of the antenna assembly shown in FIGS. 26 and 27 and illustrating the threaded stem portion and stopping members for retaining the rotatably convertible support in the first or second configuration.
Figure 29:
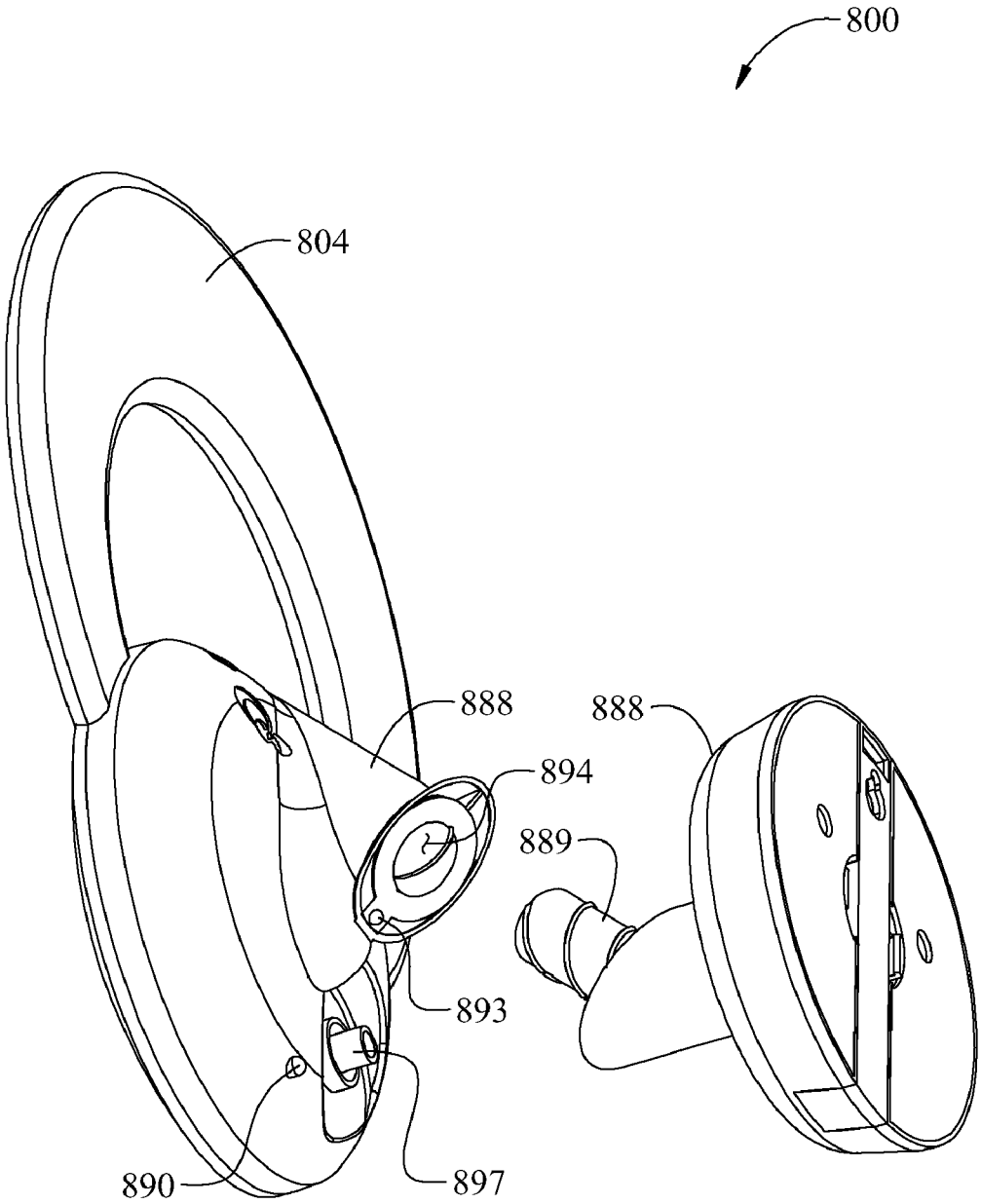
FIG. 29 is another exploded perspective view of the antenna assembly shown in FIGS. 26 and 27.

By way of example, a user may rotate the support 888 to convert the support 888 from the first configuration (FIG. 26) to the second configuration (FIG. 27), or vice versa. As shown in FIGS. 28 and 29, the rotatably convertible support 888 includes a threaded stem portion 889 and a threaded opening 894. In this example, the threaded stem portion 889 extends upwardly from the base of the support 888, and the threaded opening 894 is defined by the upper portion of the support 888. In other embodiments, this may be reversed such that the base includes threaded opening, and the threaded stem portion extends downwardly from the upper portion of the mount.

Figure 30:
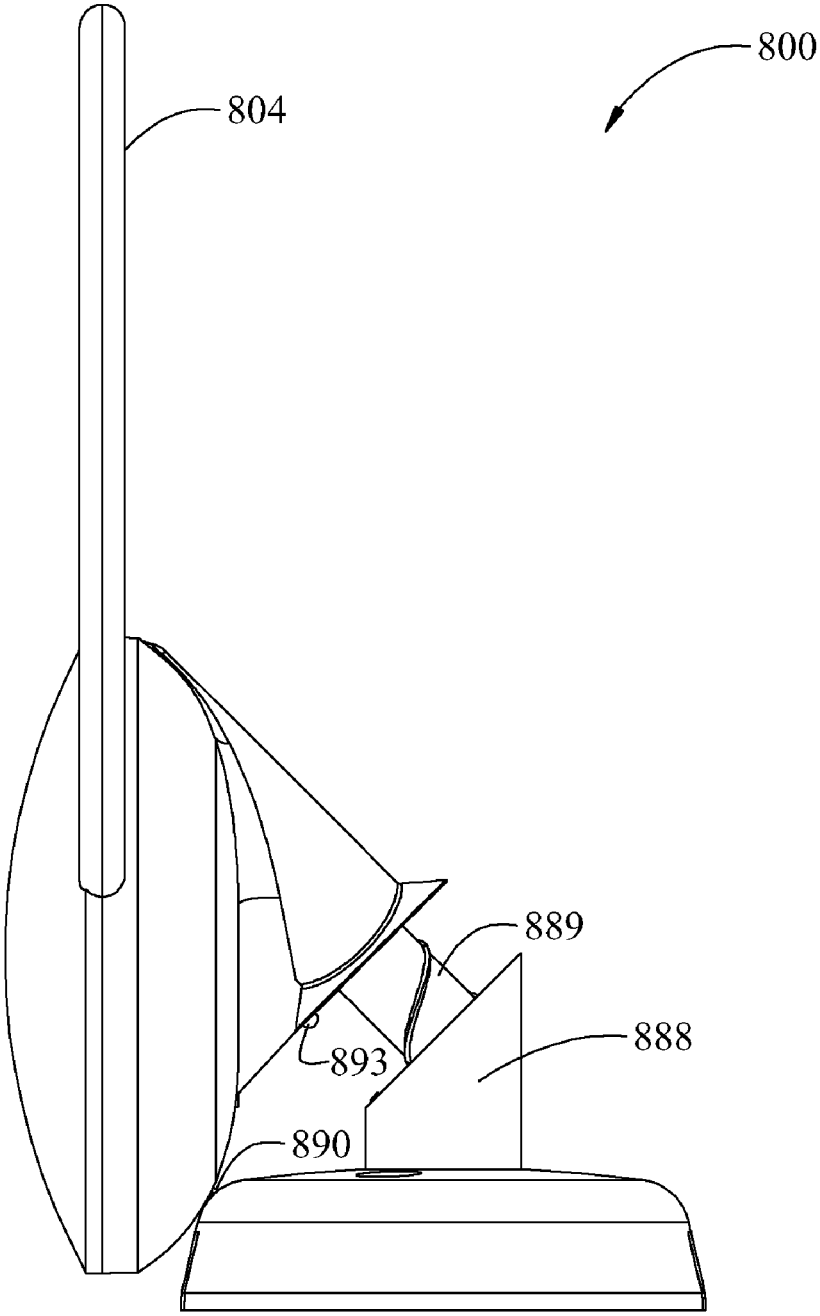
FIG. 30 is a right side view of the antenna assembly shown in FIG. 26 with the rotatably convertible support shown in the first configuration for supporting the antenna assembly on a horizontal surface.
Figure 31:
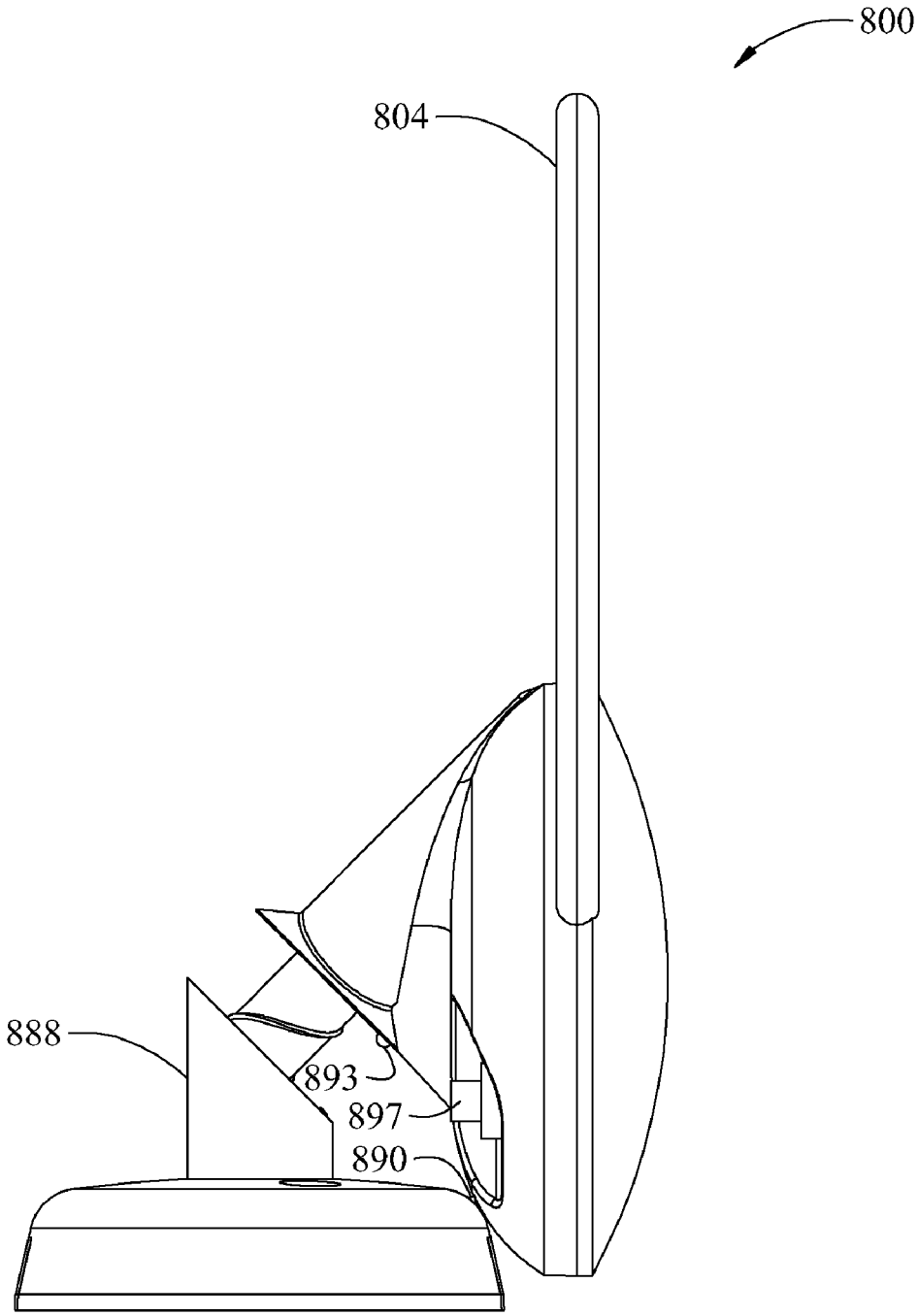
FIG. 31 is a left side view of the antenna assembly shown in FIG. 26.
Figure 32:
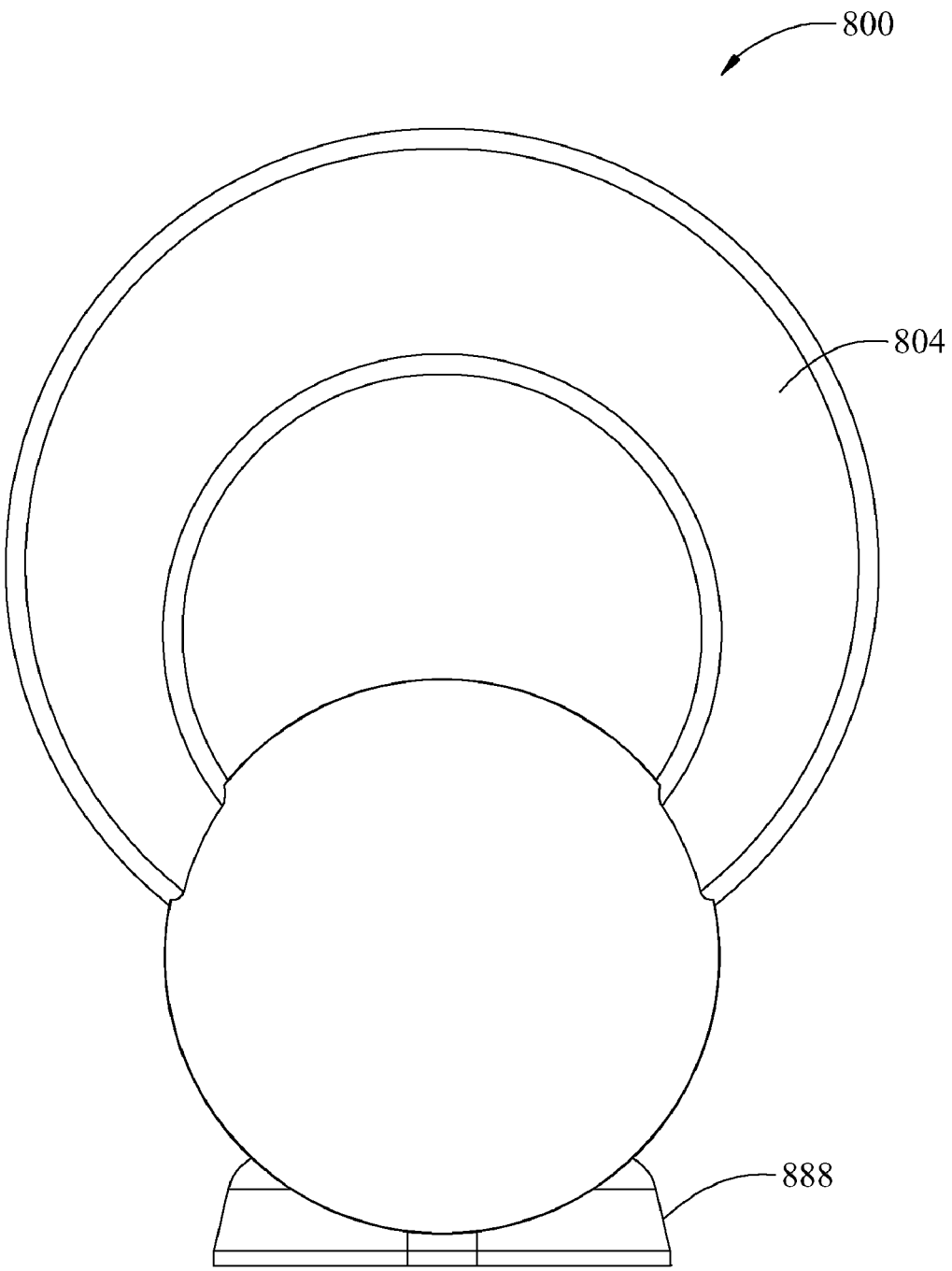
FIG. 32 is a front view of the antenna assembly shown in FIG. 26.
Figure 34:
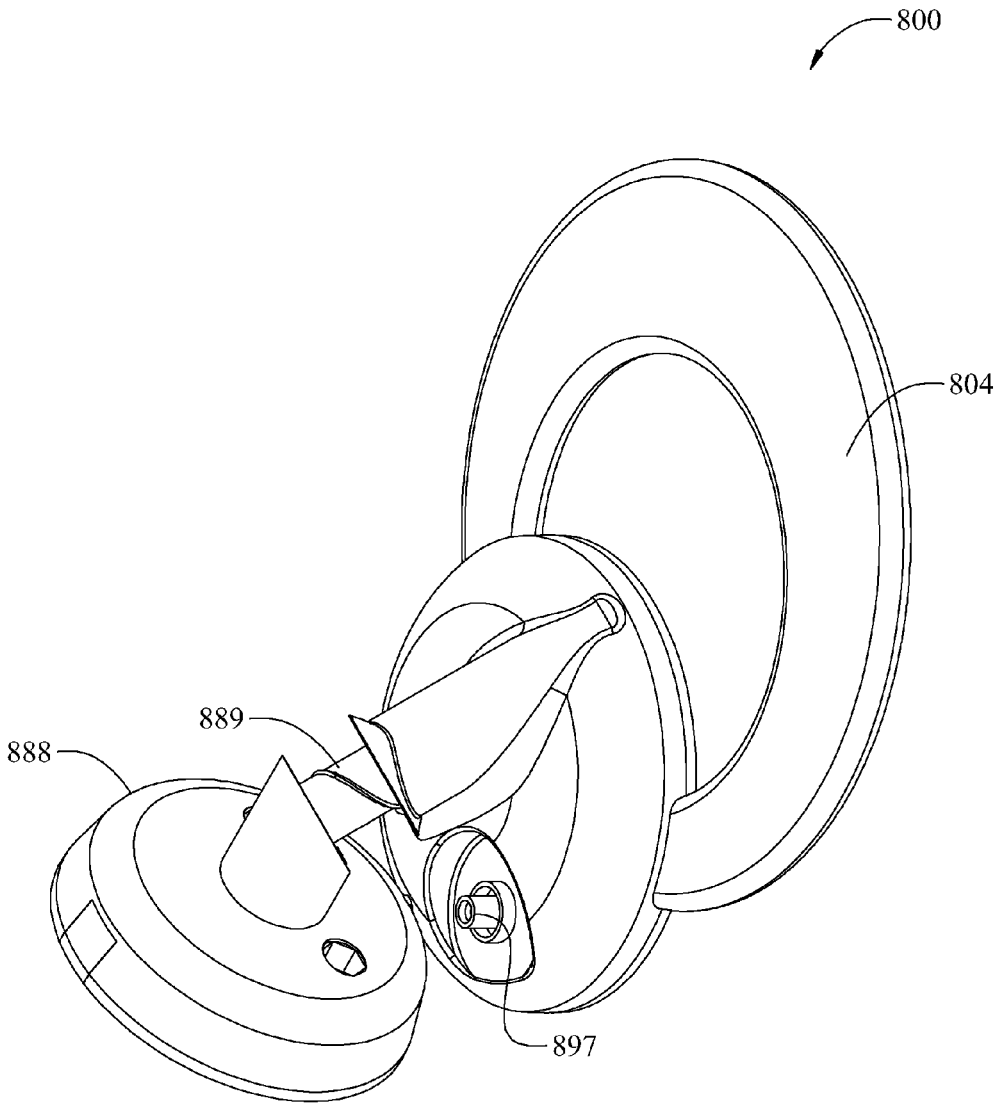
FIG. 34 is an upper back perspective view of the antenna assembly shown in FIG. 26.
Figure 35:
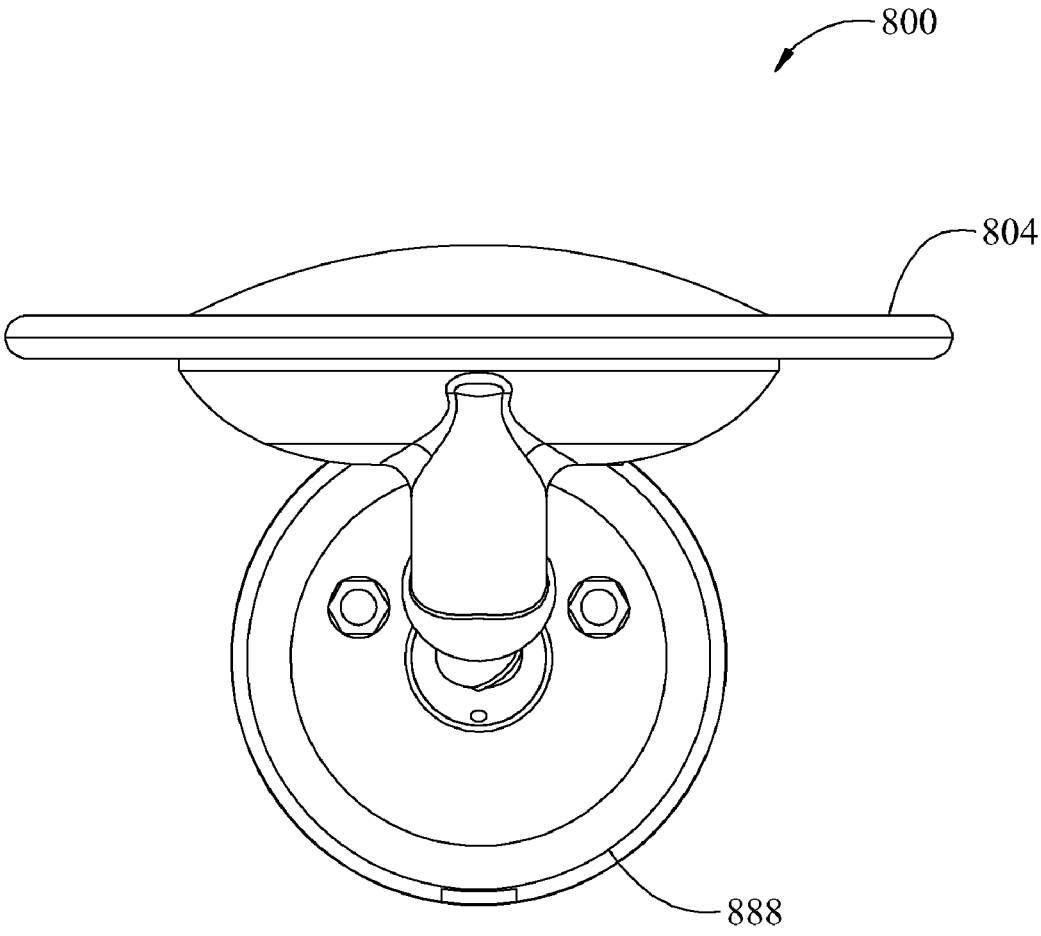
FIG. 35 is a top view of the antenna assembly shown in FIG. 26.
Figure 36:
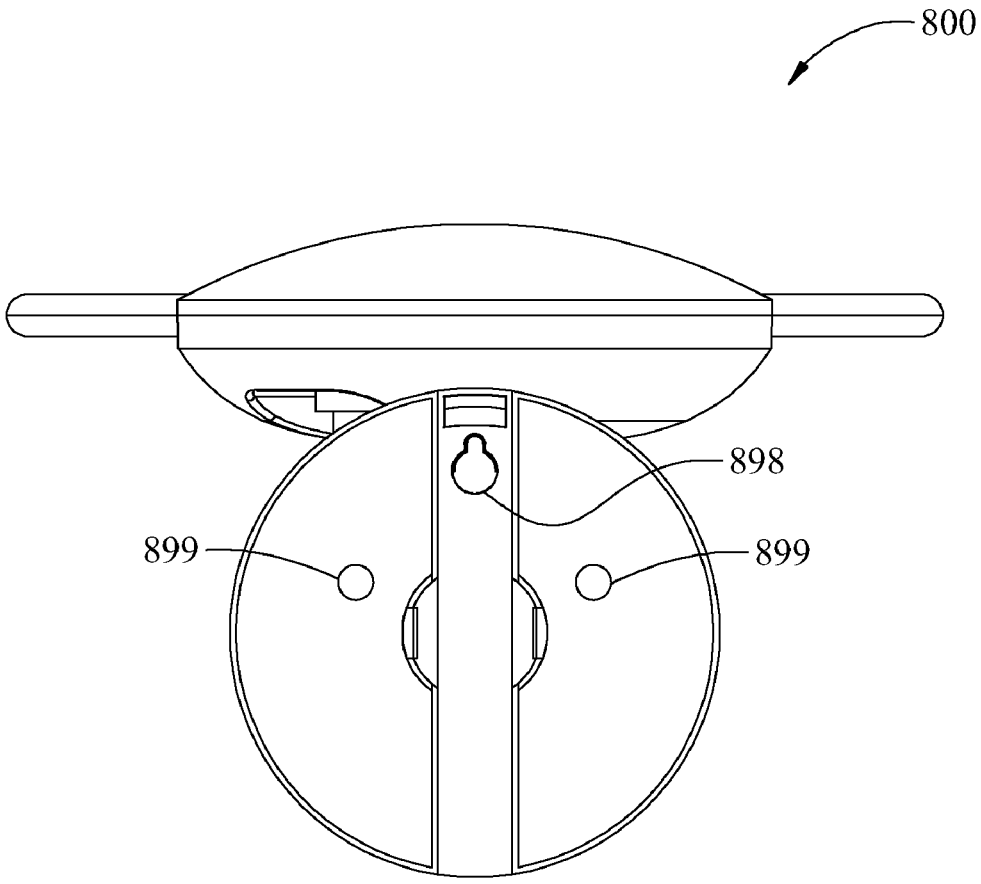
FIG. 36 is a bottom view of the antenna assembly shown in FIG. 26.
Figure 37:
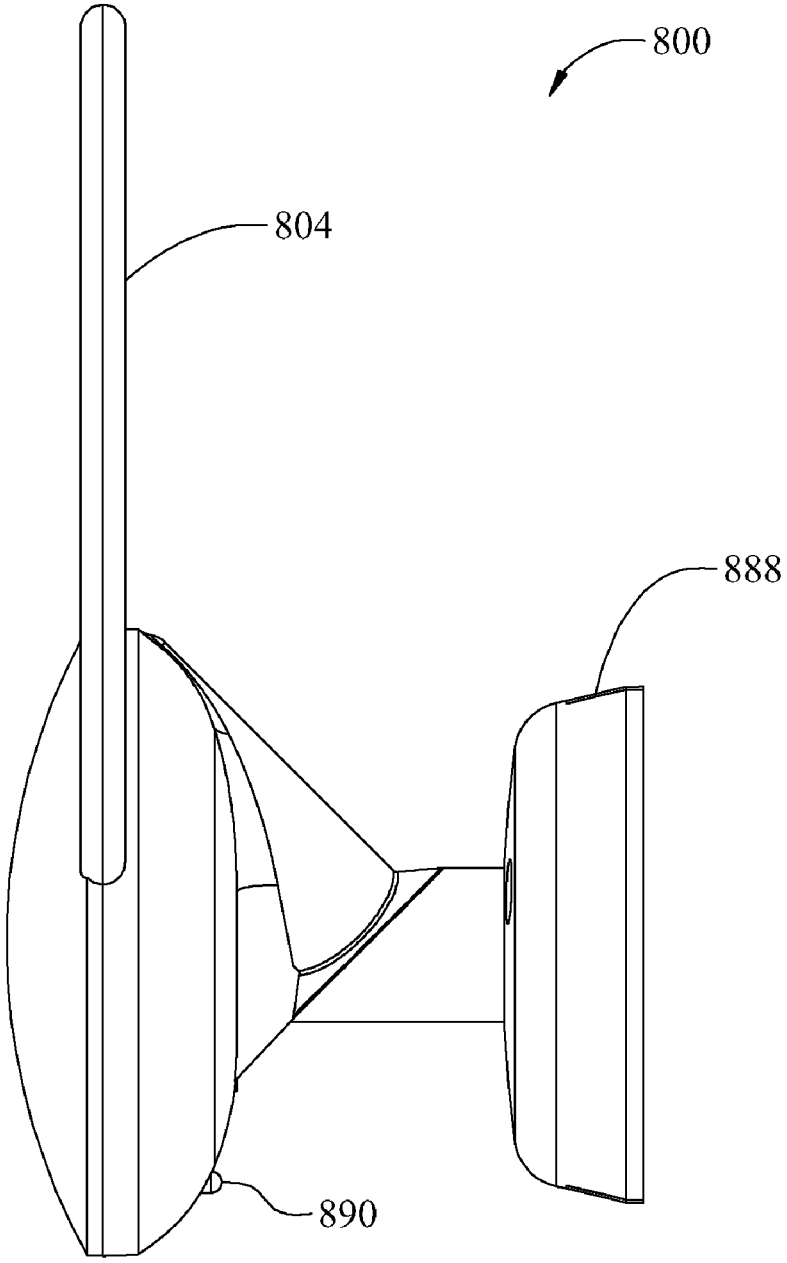
FIG. 37 is a right side view of the antenna assembly shown in FIG. 27 with the rotatably convertible support shown in the second configuration for supporting the antenna assembly from a vertical surface.
Figure 38:
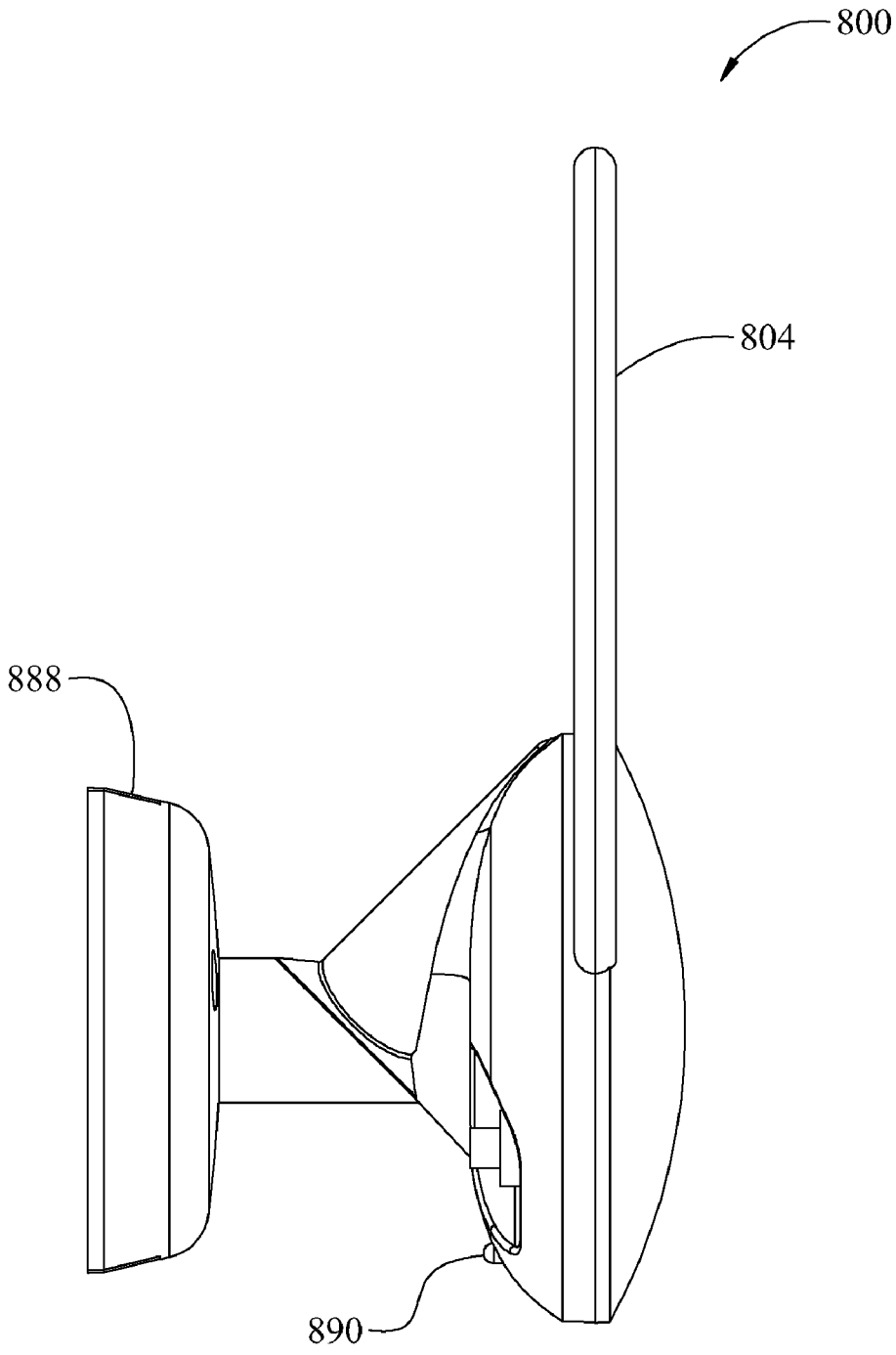
FIG. 38 is a left side view of the antenna assembly shown in FIG. 27.
Figure 39:
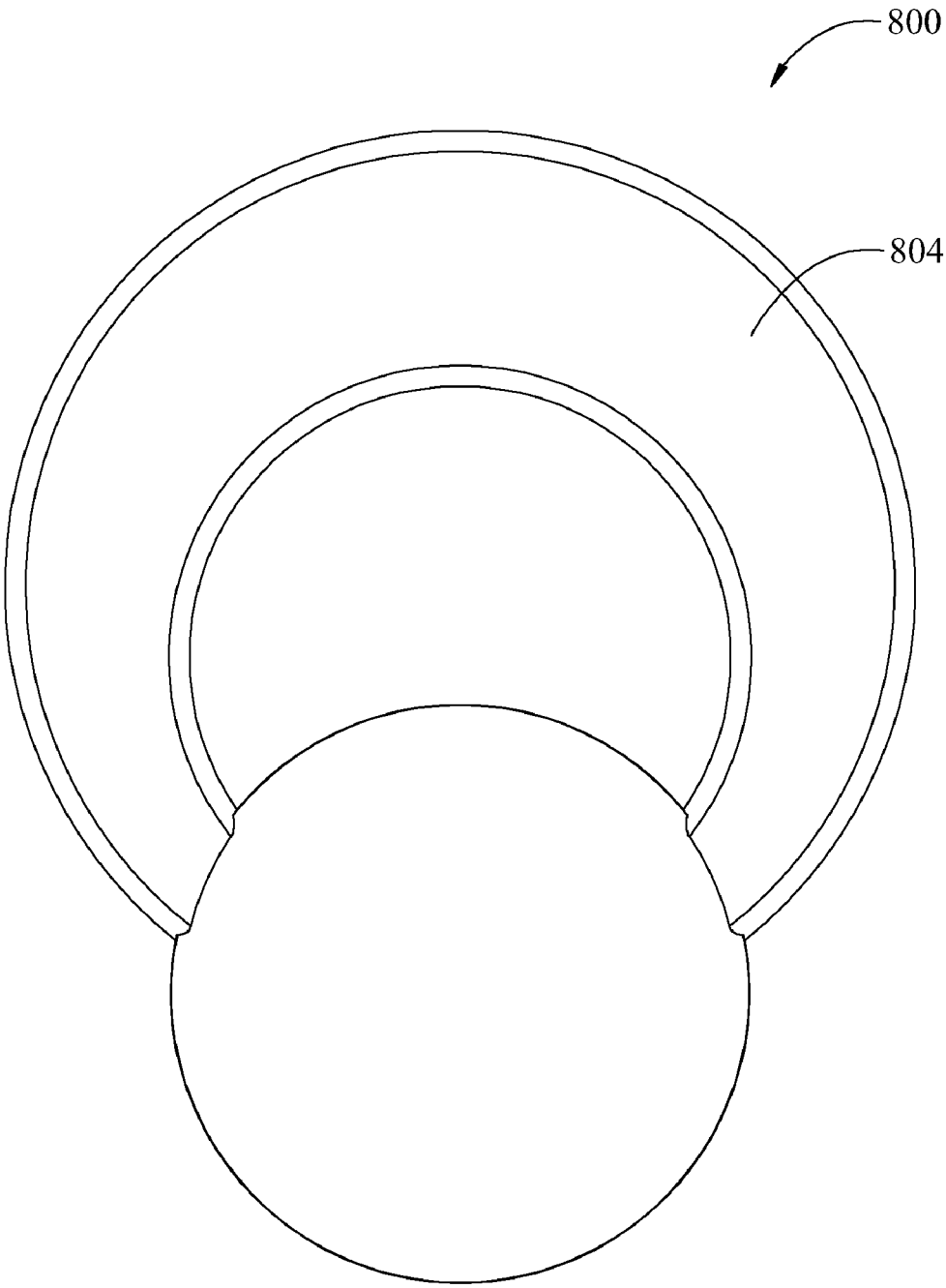
FIG. 39 is a front view of the antenna assembly shown in FIG. 27.
Figure 40:
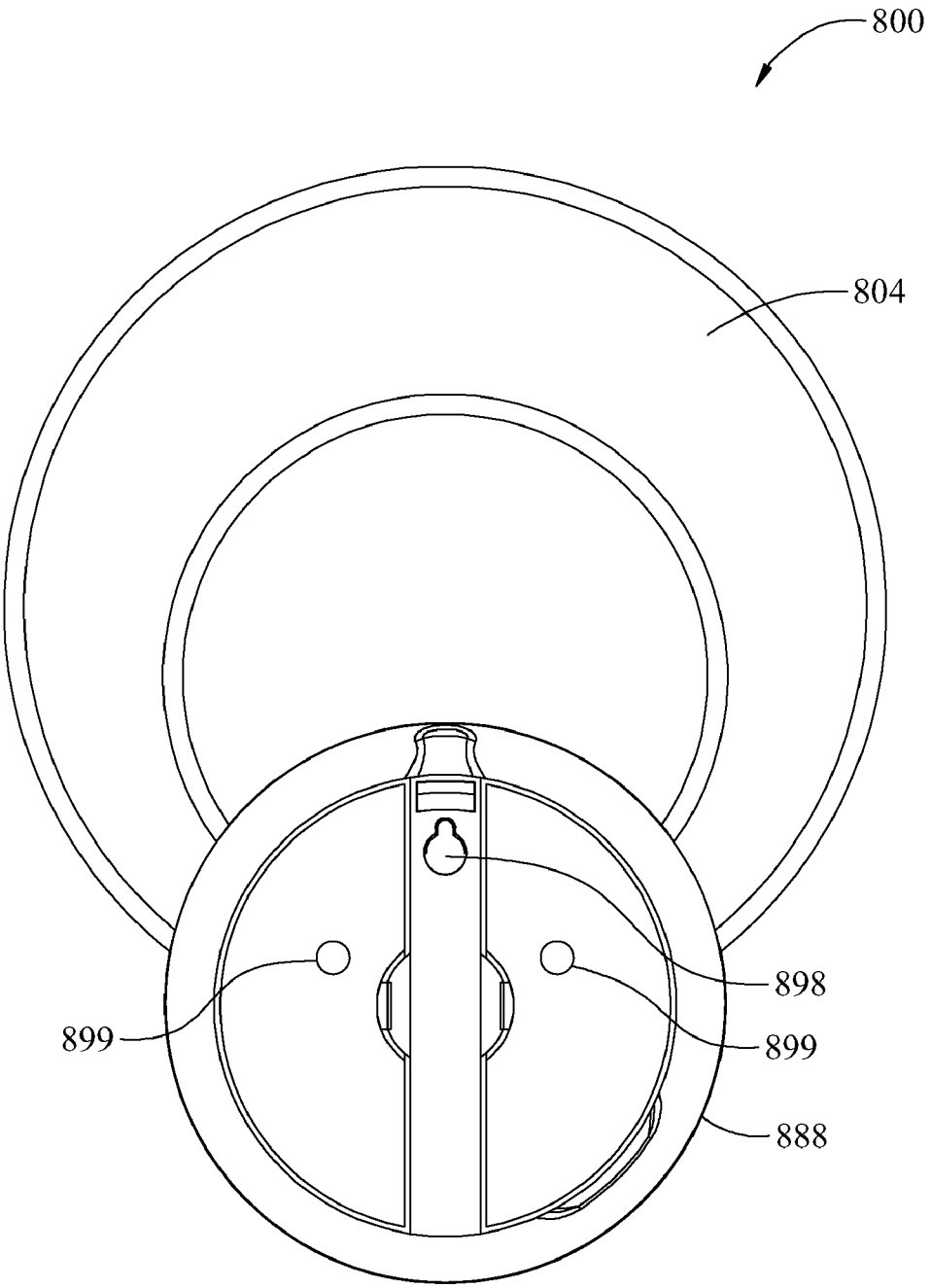
FIG. 40 is a back view of the antenna assembly shown in FIG. 27.
Figure 41:
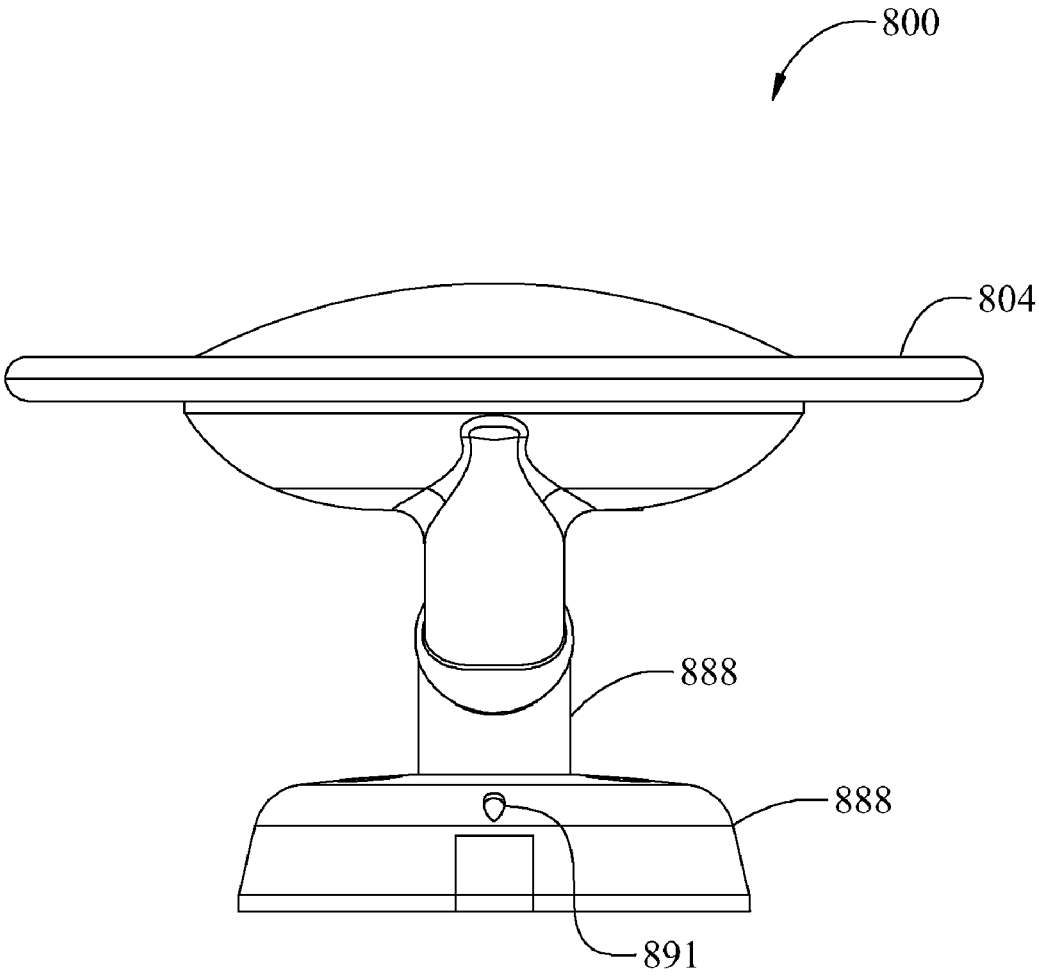
FIG. 41 is a top view of the antenna assembly shown in FIG. 27.
Figure 42:
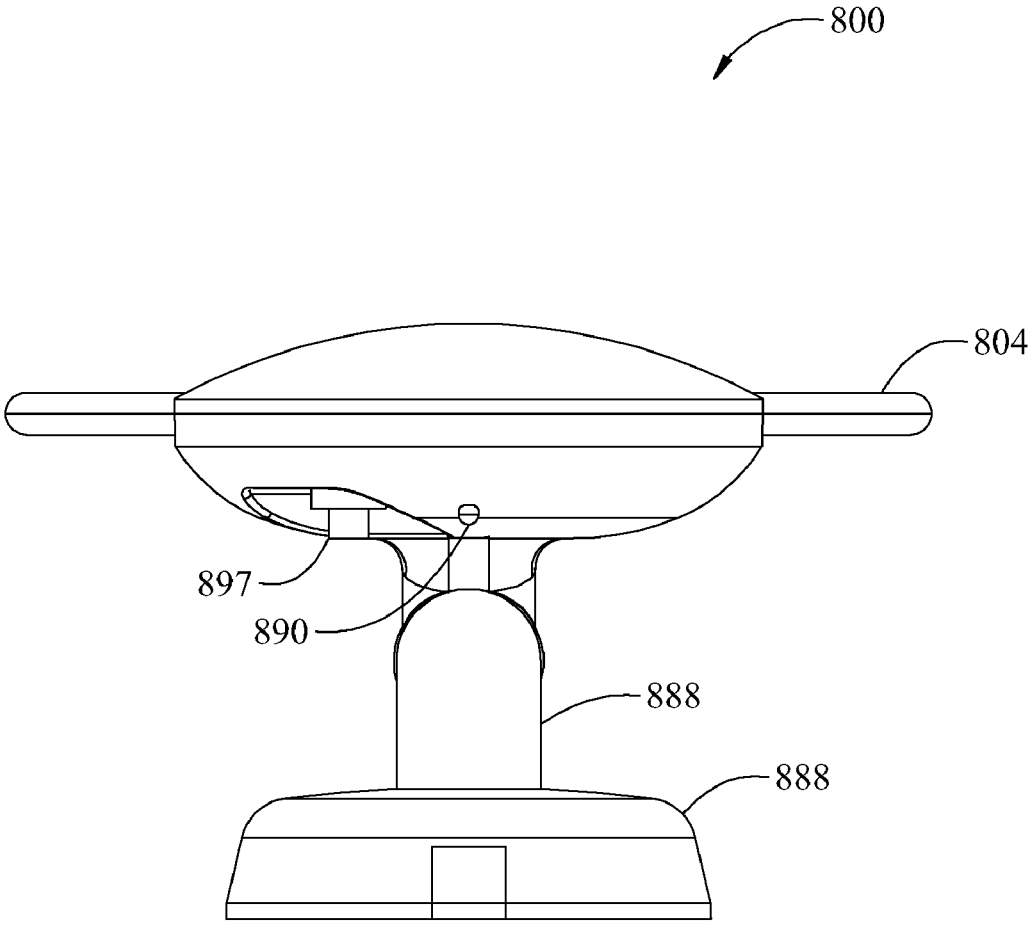
FIG. 42 is a bottom view of the antenna assembly shown in FIG. 27.

With continued reference to FIGS. 28 and 29, the support 888 also includes stops for retaining the rotatably convertible support 888 in the first or second configuration. In this example embodiment as shown in FIG. 28, the support 888 include a first stop 890 (e.g., projection, nub, protrusion, protuberance, etc.) configured to be engagingly received within an opening 891, for retaining the support 888 in the first configuration. FIGS. 30, 31, and 34 illustrate the engagement of the first stop 890 within the opening 891, which inhibits relative rotation of the upper and lower portions of the support 888 thus helping retain support 888 in the first configuration for supporting the antenna assembly 800 on a horizontal surface. In this example, the first stop 890 is provided on the upper portion of the support 888 and the opening 891 is on the lower portion or base of the support 888. In other embodiments, this may be reversed such that the base includes the first stop and the opening is on the upper portion of the support.

The support 888 also include a second stop 893 (FIG. 29) (e.g., projection, nub, protrusion, protuberance, etc.) configured to be engagingly received within an opening 892 (FIG. 28), for retaining the support 888 in the second configuration. The engagement of the second stop 893 within the opening 892 inhibits relative rotation of the upper and lower portions of the support 888 thus helping retain support 888 in the second configuration for supporting the antenna assembly 800 from a vertical surface. In this example, the second stop 893 is provided on the upper portion of the support 888 and the opening 892 is on the lower portion or base of the support 888. In other embodiments, this may be reversed such that the base includes the second stop and the opening is on the upper portion of the support.

In addition helping retain the support 888 in either the first or second configuration, the stops may also help provide a tactile and/or audible indication to the user to stop rotating the upper or lower portion of the support 888 relative to the other portion. For example, as a user is reconfiguring or converting the support 888 from the first or second configuration to the other configuration, the user may feel and/or hear an audible click as the corresponding first or second stop 890, 893 is engaged into the corresponding opening 891, 892.

Figure 33:
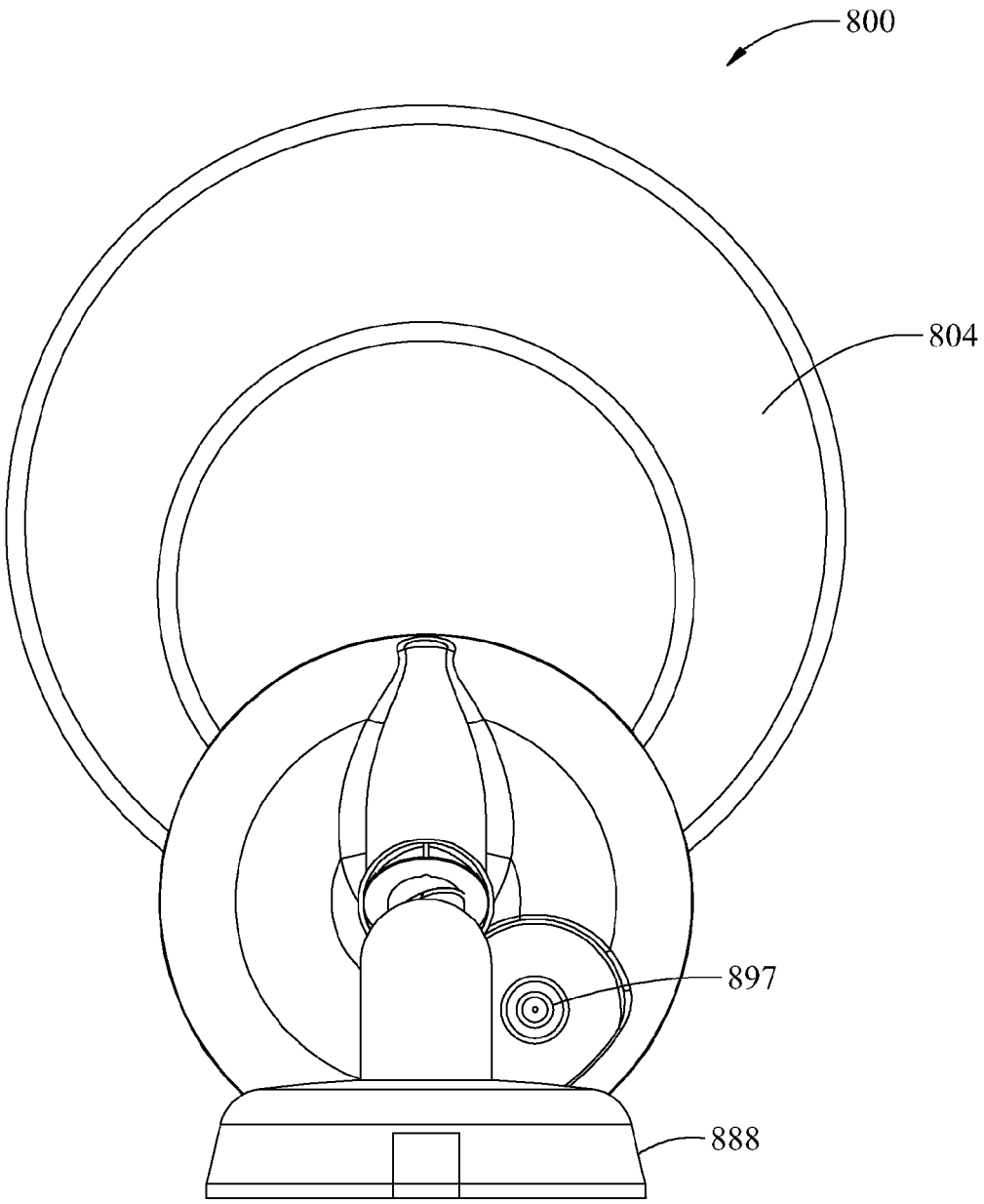
FIG. 33 is a back view of the antenna assembly shown in FIG. 26.

As shown in FIGS. 29 and 33, the antenna assembly 800 includes a connector 897 for connecting a coaxial cable to the antenna assembly 800. Alternative embodiments may include different types of connectors.

The antenna assemblies 300 (FIGS. 14 and 15), 400 (FIG. 16), and 800 (FIGS. 26 through 42) do not include a reflector similar to the reflectors 108 and 208. In some embodiments, the antenna assemblies 300, 400, 800 have provided good VSWR (voltage standing wave ratio) without a reflector. In other embodiments, however, the antenna assemblies 300, 400, 800 do include such a reflector. The antenna assemblies 300, 400, 800 may be operable and configured similar to the antenna assemblies 100 and 200 in at least some embodiments thereof. The illustrated circular shapes of the supports 388, 488, 888 are only exemplary embodiments. The support 388, 488, 888 may have many shapes (e.g. square, hexagonal, etc.). Removing a reflector may result in an antenna with less gain but wider bi-directional pattern, which may be advantageous for some situations where the signal strength level is high and from various directions.

Figure 17:
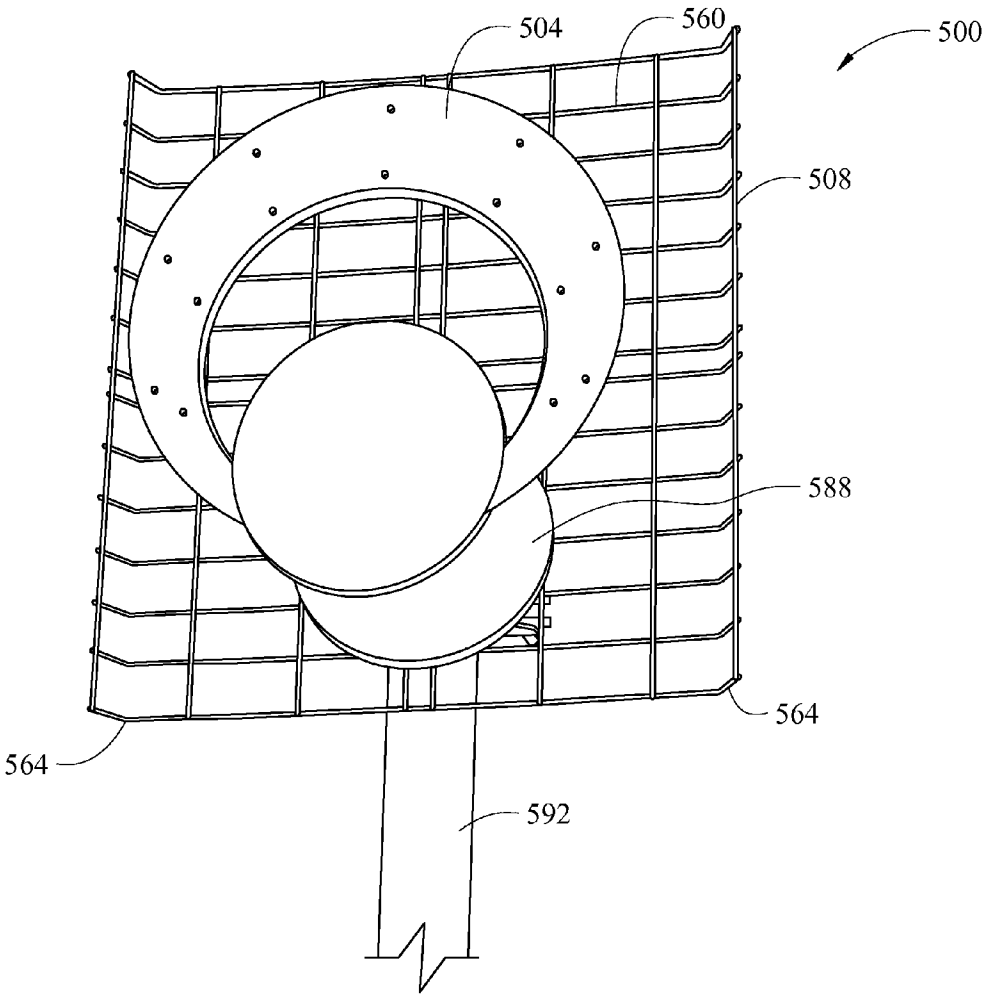
FIG. 17 is a perspective view of another exemplary embodiment of an antenna assembly having a tapered loop antenna element and a support, and showing the antenna assembly mounted outdoors to a vertical mast or pole.
Figure 18:
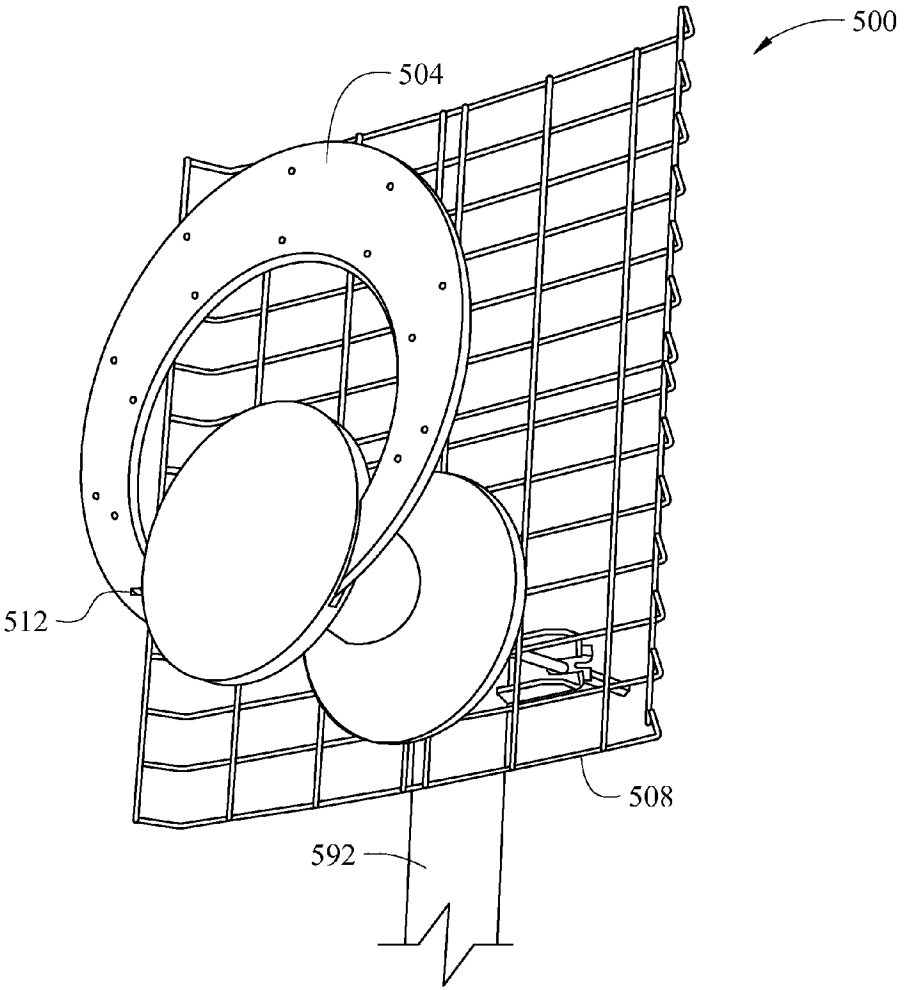
FIG. 18 is another perspective view of the antenna assembly shown in FIG. 17.
Figure 19:
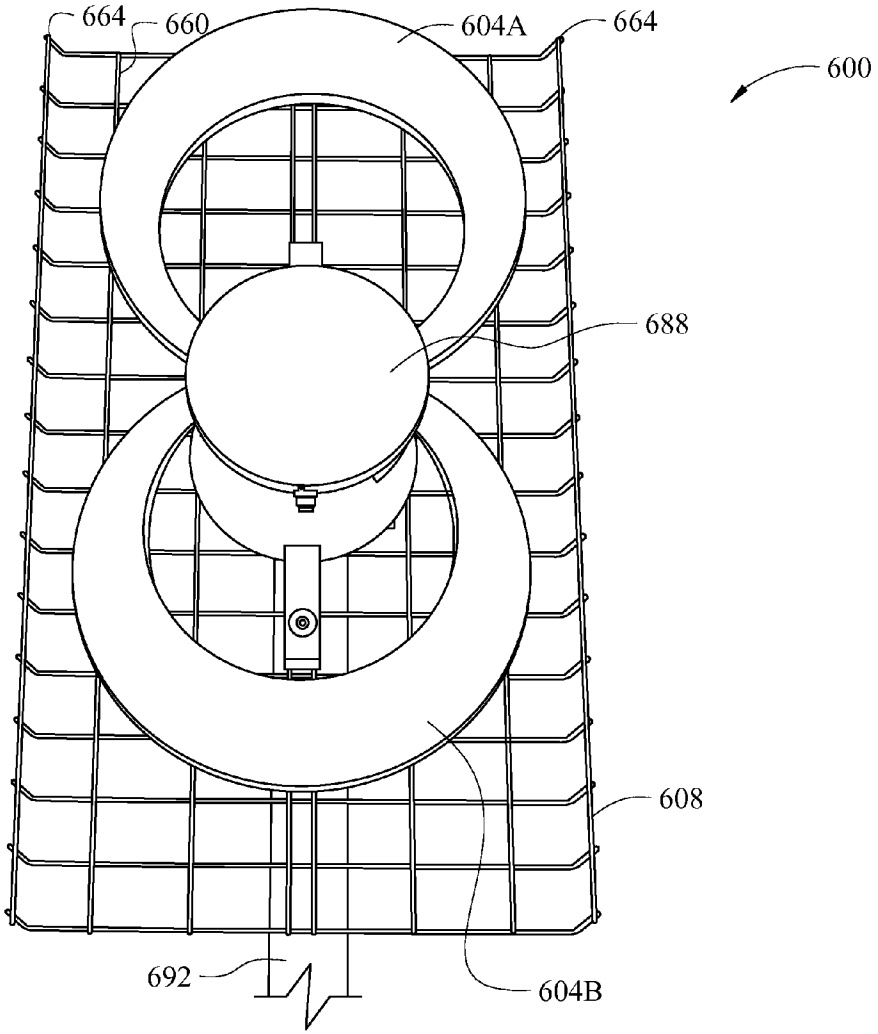
FIG. 19 is a perspective view of another exemplary embodiment of an antenna assembly having two tapered loop antenna elements and a support, and showing the antenna assembly mounted outdoors to a vertical mast or pole.

Other exemplary embodiments of antenna assemblies for mounting outdoors are illustrated in FIGS. 17 through 19. FIGS. 17 and 18 show an antenna assembly 500 having a tapered loop antenna element 504, a printed circuit board balun 512, and a support 588, where the antenna assembly 500 is mounted outdoors to a vertical mast or pole 592. FIG. 19 shows an antenna assembly 600 having two tapered loop antenna elements 604A and 604B and a support 688, where the antenna assembly 600 is mounted outdoors to a vertical mast or pole 692. In various embodiments, the supports 588 and/or 688 may be nonconvertible, or they may be rotatably convertible in a manner substantially similar to the support 888.

The antenna assemblies 500 and 600 include reflectors 508 and 608. Unlike the generally solid planar surface of reflectors 108 and 208, the reflectors 508 and 608 have a grill or mesh surface 560 and 660. The reflector 508 also includes two perimeter flanges 564, while the reflector 608 includes two perimeter flanges 664. A mesh reflector is generally preferred for outdoor applications to reduce wind loading. With outdoor uses, size is generally less important such that the mesh reflector may be made somewhat larger than the equivalent indoor models to compensate for the inefficiency of the mesh. The increased size of the mesh reflector also removes or reduces the need for a baffle, which is generally more important on indoor models that tend to be at about the limit of the size versus performance curves.

Any of the various embodiments shown in FIGS. 14 through 19 and FIGS. 26 through 42 may include one or more components (e.g., balun, reflector, etc.) similar to components of antenna assembly 100. In addition, any of the various embodiments shown in FIGS. 14 through 19 and FIGS. 26 through 42 may be operable and configured similar to the antenna assembly 100 in at least some embodiments thereof.

According to some embodiments, an antenna element for signals in the very high frequency (VHF) range (e.g., 170 Megahertz to 216 Megahertz, etc.) may be less circular in shape but still based on an underlying electrical geometry of antenna elements disclosed herein. A VHF antenna element, for example, may be configured to provide electrical paths of more than one length along an inner and outer periphery of the antenna element. The proper combination of such an element with an electrically small reflector may thus result in superior balance of directivity, efficiency, bandwidth, and physical size as what may be achieved in other example antenna assemblies disclosed herein.

For example, FIGS. 21 through 24 illustrate an exemplary embodiment of an antenna assembly 700, which may be used for reception of VHF signals (e.g., signals within a frequency bandwidth of 170 Megahertz to 216 Megahertz, etc.). As shown, the antenna assembly 700 includes an antenna element 704 and a reflector 708.

The antenna element 704 has an outer periphery or perimeter portion 740 and an inner periphery or perimeter portion 744. The outer periphery or perimeter portion 740 is generally rectangular. The inner periphery or perimeter portion 744 is also generally rectangular. In addition, the antenna element 704 also includes a tuning bar 793 disposed or extending generally between the two side members 794 of the antenna element 704. The tuning bar 793 is generally parallel with the top member 795 and bottom members 796 of the antenna element 704. The tuning bar 793 extends across the antenna element 704, such that the antenna element 704 includes a lower generally rectangular opening 748 and an upper generally rectangular opening 749. The antenna element 704 further includes spaced-apart end portions 728.

With the tuning bar 793, the antenna element 704 includes first and second electrical paths of different lengths, where the shorter electrical path includes the tuning bar 793 and the longer electrical path does not. The longer electrical path is defined by an outer loop of the antenna element 704, which includes the antenna element's spaced-apart end portions 728, bottom members 796, side members 794, and top member 795. The shorter electrical path is defined by an inner loop of the antenna element 704, which includes the antenna element's spaced-apart end portions 728, bottom members 796, portions of the side members 794 (the portions between the tuning bar 793 and bottom members 796), and the tuning bar 793. By a complex coupling theory, the electrical paths defined by the inner and outer loops of the antenna element 704 allow for efficient operation within the VHF bandwidth range of about 170 Megahertz to about 216 Megahertz in some embodiments. With the greater efficiency, the size of the antenna assembly may thus be reduced (e.g., 75% size reduction, etc.) and still provide satisfactory operating characteristics.

The tuning bar 793 may be configured (e.g., sized, shaped, located, etc.) so as to provide impedance matching for the antenna element 704. In some example embodiments, the tuning bar 793 may provide the antenna element 704 with a more closely matched impedance to a 300 ohm transformer.

In one particular example, the end portions 728 of the antenna element 704 are spaced apart a distance of about 2.5 millimeters. By way of further example, the antenna element 704 may be configured to have a width (from left to right in FIG. 22) of about 600 millimeters, a height (from top to bottom in FIG. 22) of about 400 millimeters, and have the tuning bar 793 spaced above the bottom members 796 by a distance of about 278 millimeters. A wide range of materials may be used for the antenna element 704. In one exemplary embodiment, the antenna element 704 is made from aluminum hollow tubing with a ¾ inch by ¾ inch square cross section. In this particular example, the various portions (728, 793, 794, 795, 796) of the antenna element 704 are all formed from the same aluminum tubing, although this is not required for all embodiments. Alternative embodiments may include an antenna element configured differently, such as from different materials (e.g., other materials besides aluminum, antenna elements with portions formed from different materials, etc.), non-rectangular shapes and/or different dimensions (e.g., end portions spaced apart greater than or less than 2.5 millimeters, etc.). For example, some embodiments include an antenna element with end portions spaced apart a distance of between about 2 millimeters to about 5 millimeters. The spaced-apart end portions may define an open slot therebetween that is operable to provide a gap feed for use with a balanced transmission line.

With continued reference to FIGS. 21 through 24, the reflector 708 includes a grill or mesh surface 760. The reflector 708 also includes two perimeter flanges 764. The perimeter flanges 764 may extend outwardly from the mesh surface 760. In addition, members 797 may be disposed behind the mesh surface 760, to provide reinforcement to the mesh surface 760 and/or a means for supporting or coupling the mesh surface 760 to a supporting structure. By way of example only, the reflector 708 may be configured to have a width (from left to right in FIG. 22) of about 642 millimeters, a height (from top to bottom in FIG. 22) of about 505 millimeters, and be spaced apart from the antenna element 704 with a distance of about 200 millimeters separating the reflector's mesh surface 760 from the back surface of the antenna element 704. Also, by way of example only, the perimeter flanges 764 may be about 23 millimeters long and extend outwardly at an angle of about 120 degrees from the mesh surface 760. A wide range of material may be used for the reflector 708. In one exemplary embodiment, the reflector 708 includes vinyl coated steel. Alternative embodiments may include a differently configured reflector (e.g., different material, shape, size, location, etc.), no reflector, or a reflector positioned closer or farther away from the antenna element.

Figure 25:
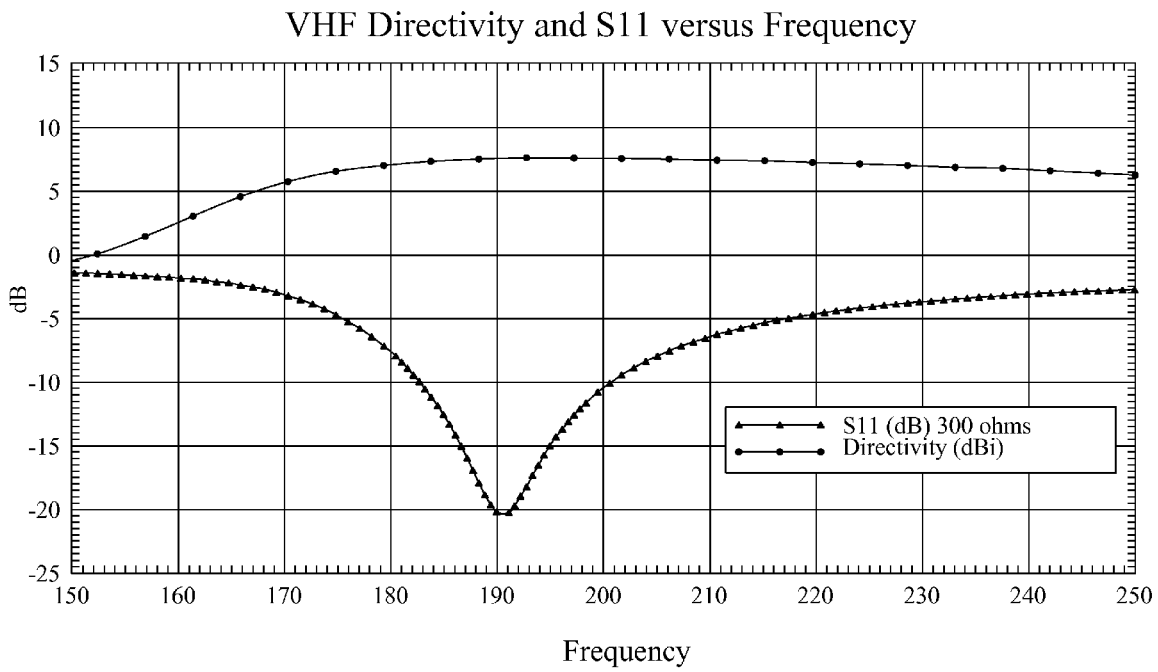
FIG. 25 is an exemplary line graph showing computer-simulated directivity and VSWR (voltage standing wave ratio) versus frequency (in megahertz) for the antenna assembly shown in FIGS. 21 through 24 according to an exemplary embodiment.

FIG. 25 is an exemplary line graph showing computer-simulated directivity and VSWR (voltage standing wave ratio) versus frequency (in megahertz) for the antenna assembly 700 according to an exemplary embodiment.

Accordingly, embodiments of the present disclosure include antenna assemblies that may be scalable to any number of (one or more) antenna elements depending, for example, on the particular end-use, signals to be received or transmitted by the antenna assembly, and/or desired operating range for the antenna assembly. By way of example only, another exemplary embodiment of an antenna assembly includes four tapered loop antenna elements, which are collectively operable for improving the overall range of the antenna assembly.

Other embodiments relate to methods of making and/or using antenna assemblies. Various embodiments relate to methods of receiving digital television signals, such as high definition television signals within a frequency range of about 174 megahertz to about 216 megahertz and/or a frequency range of about 470 megahertz to about 690 megahertz. In one example embodiment, a method generally includes connecting at least one communication link from an antenna assembly to a television for communicating signals to the television that are received by the antenna assembly. In this method embodiment, the antenna assembly (e.g., 100, etc.) may include at least one antenna element (e.g., 104, etc.) and at least one reflector element (e.g., 108, etc.). In some embodiments, there may be a free-standing antenna element without any reflector element, where the free-standing antenna element may provide good impedance bandwidth, but low directivity for very compact solutions that work in high signal areas. In another example, a method may include rotating a portion of a support (e.g., support 888, etc.) to a first or a second configuration, where the support in the first configuration allows an antenna assembly to be supported on a horizontal surface and the support in the second configuration allows the antenna assembly to be supported on a vertical surface.

The antenna assembly may include a balun (e.g., 112, etc.) and a housing (e.g., 116, etc.). The antenna assembly may be operable for receiving high definition television signals having a frequency range of about 470 megahertz and about 690 megahertz. The antenna element may have a generally annular shape with an opening (e.g., 148, etc.). The antenna element 104 (along with reflector size, baffle, and spacing) may be tuned to at least one electrical resonant frequency for operating within a bandwidth ranging from about 470 megahertz to about 690 megahertz. The reflector element may be spaced-apart from the antenna element for reflecting electromagnetic waves generally towards the antenna element and generally affecting impedance bandwidth and directionality. The antenna element may include spaced-apart first and second end portions (e.g., 128, etc.), a middle portion (e.g., 126, etc.), first and second curved portions (e.g., 150, 152, etc.) extending from the respective first and second end portions to the middle portion such that the antenna element's annular shape and opening are generally circular. The first and second curved portions may gradually increase in width from the respective first and second end portions to the middle portion such that the middle portion is wider than the first and second end portions and such that an outer diameter of the antenna element is offset from a diameter of the generally circular opening. The first curved portion may be a mirror image of the second curved portion. A center of the generally circular opening may be offset from a center of the generally circular annular shape of the antenna element. The reflector element may include a baffle (e.g., 164, etc.) for deflecting electromagnetic waves. The baffle may be located at least partially along at least one perimeter edge portion of the reflector element. The reflector element may include a substantially planar surface (e.g., 160, etc.) that is substantially parallel with the antenna element, and at least one sidewall portion (e.g., 164, etc.) extending outwardly relative to the substantially planar surface generally towards the tapered loop antenna element. In some embodiments, the reflector element includes sidewall portions along perimeter edge portions of the reflector element, which are substantially perpendicular to the substantially planar surface of the reflector element, whereby the sidewall portions are operable as a baffle for deflecting electromagnetic wave energy.

Embodiments of an antenna assembly disclosed herein may be configured to provide one or more of the following advantages. For example, embodiments disclosed herein may provide antenna assemblies that are physically and electrically small but still capable of operating and behaving similar to physically larger and electrically larger antenna assemblies. Exemplary embodiments disclosed may provide antenna assemblies that are relatively small and unobtrusive, which may be used indoors for receiving signals (e.g., signals associated with digital television (of which high definition television signals are a subset), etc.). By way of further example, exemplary embodiments disclosed herein may be specifically configured for reception (e.g., tuned and/or targeted, etc.) for use with the year 2009 digital television (DTV) spectrum of frequencies (e.g., HDTV signals within a first frequency range of about 174 megahertz and about 216 megahertz and signals within a second frequency range of about 470 megahertz and about 690 megahertz, etc.). Exemplary embodiments disclosed herein may thus be relatively highly efficient (e.g., about 90 percent, about 98 percent at 545 MHz, etc.) and have relatively good gain (e.g., about eight dBi maximum gain, excellent impedance curves, flat gain curves, relatively even gain across the 2009 DTV spectrum, relatively high gain with only about 25.4 centimeter by about 25.4 centimeter footprint, etc.). With such relatively good efficiency and gain, high quality television reception may be achieved without requiring or needing amplification of the signals received by some exemplary antenna embodiments. Additionally, or alternatively, exemplary embodiments may also be configured for receiving VHF and/or UHF signals.

Exemplary embodiments of antenna assemblies (e.g., 100, 200, etc.) have been disclosed herein as being used for reception of digital television signals, such as HDTV signals. Alternative embodiments, however, may include antenna elements tuned for receiving non-television signals and/or signals having frequencies not associated with HDTV. Other embodiments may be used for receiving AM/FM radio signals, UHF signals, VHF signals, etc. Thus, embodiments of the present disclosure should not be limited to receiving only television signals having a frequency or within a frequency range associated with digital television or HDTV. Antenna assemblies disclosed herein may alternatively be used in conjunction with any of a wide range of electronic devices, such as radios, computers, etc. Therefore, the scope of the present disclosure should not be limited to use with only televisions and signals associated with television.

Numerical dimensions and specific materials disclosed herein are provided for illustrative purposes only. The particular dimensions and specific materials disclosed herein are not intended to limit the scope of the present disclosure, as other embodiments may be sized differently, shaped differently, and/or be formed from different materials and/or processes depending, for example, on the particular application and intended end use.

Certain terminology is used herein for purposes of reference only, and thus is not intended to be limiting. For example, terms such as "upper", "lower", "above", "below", "upward", "downward", "forward", and "rearward" refer to directions in the drawings to which reference is made. Terms such as "front", "back", "rear", "bottom" and "side", describe the orientation of portions of the component within a consistent, but arbitrary, frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

Disclosure of values and ranges of values for specific parameters (such frequency ranges, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. An antenna assembly comprising:

a tapered loop antenna element having a generally annular shape with an opening; and a rotatably convertible support including a base and an upper portion coupled to the tapered loop antenna element, the upper portion rotatable relative to the base between a first configuration for supporting the tapered loop antenna element on a horizontal surface and a second configuration for supporting the tapered loop antenna element from a vertical surface;

wherein the rotatably convertible support is configured such that:

rotation of the upper portion relative to the base in a first direction converts the rotatably convertible support from the first configuration to the second configuration; and rotation of the upper portion relative to the base in a second direction opposite the first direction converts the rotatably convertible support from the second configuration to the first configuration.

2. The antenna assembly of claim 1, configured for operating within a bandwidth ranging from about 470 megahertz to about 690 megahertz, the tapered loop antenna element comprising:

spaced-apart first and second end portions;

a middle portion; and first and second curved portions extending from the respective first and second end portions to the middle portion such that the tapered loop antenna element has a generally circular annular shape with a generally circular opening;

the first and second curved portions gradually increasing in width from the respective first and second end portions to the middle portion such that the middle portion is wider than the first and second end portions and such that an outer diameter of the tapered loop antenna element is offset from a diameter of the generally circular opening;

the first curved portion being a mirror image of the second curved portion.

3. The antenna assembly of claim 2, wherein the outer diameter of the tapered loop antenna element is about two hundred twenty millimeters.

4. The antenna assembly of claim 2, wherein a midpoint of the diameter of the generally circular opening is spaced apart from a midpoint of the outer diameter of the tapered loop antenna element by about twenty millimeters.

5. The antenna assembly of claim 2, wherein a center of the generally circular opening is offset from a center of the generally circular annular shape.

6. The antenna assembly of claim 2, configured for operating within a second bandwidth ranging from about 174 megahertz to about 216 megahertz.

7. The antenna assembly of claim 1, further comprising a reflector element spaced-apart from the tapered loop antenna element and including a baffle for reflecting electromagnetic waves generally towards the tapered loop antenna element.

8. The antenna assembly of claim 1, wherein the rotatably convertible support includes a threaded stem portion and a threaded opening for receiving the threaded stem portion.

9. The antenna assembly of claim 8, wherein:

the threaded stem portion extends upwardly from the base; and the threaded opening is defined by the upper portion.

10. The antenna assembly of claim 1, further comprising one or more stops for retaining the rotatably convertible support in the first configuration and/or second configuration.

11. The antenna assembly of claim 1 configured for operating within a bandwidth ranging from about 470 megahertz to about 690 megahertz, the tapered loop antenna element including:

spaced-apart end portions defining an open slot extending at least partially between the spaced-apart end portions, whereby the open slot is operable to provide a gap feed for use with a balanced transmission line; and generally circular inner and outer perimeter portions such that the tapered loop antenna element's annular shape and opening are generally circular.

12. The antenna assembly of claim 11, wherein:

the generally circular outer perimeter portion has a diameter of about two hundred twenty millimeters; and/or a center of the circle generally defined by the inner perimeter portion is about twenty millimeters below a center of the circle generally defined by the outer perimeter portion.

13. The antenna assembly of claim 11, wherein:

the tapered loop antenna element is configured such that a diameter of the generally circular inner perimeter portion is offset from a diameter of the generally circular outer perimeter portion; and the offset diameters provide the tapered loop antenna element with at least one portion wider than at least one other portion.

14. The antenna assembly of claim 13, wherein a midpoint of the diameter associated with the generally circular inner perimeter portion is below a midpoint of the diameter associated with the generally circular outer perimeter portion such that the tapered loop antenna element has a wider upper portion.

15. The antenna assembly of claim 11, wherein:

the tapered loop antenna element increases in width from the spaced-apart end portions to a wider middle portion; and the tapered loop antenna element is positioned in an orientation such that the wider middle portion is above the spaced-apart end portions and rotatably convertible support when supported from the vertical surface in the second configuration.

16. The antenna assembly of claim 11, further comprising a printed circuit board having a balun, and wherein the printed circuit board is attached to at least one of the spaced-apart end portions of the tapered loop antenna element.

17. The antenna assembly of claim 1, further comprising a digital tuner for converting digital signals received by the antenna assembly to analog signals.

18. The antenna assembly of claim 1, wherein the antenna assembly is tuned to a first electrical resonant frequency for operating within a first bandwidth ranging from about 470 megahertz to about 690 megahertz and is tuned to a second electrical resonant frequency for operating within a second bandwidth ranging from about 174 megahertz to about 216 megahertz.

19. The antenna assembly of claim 1, wherein the antenna assembly includes two of said tapered loop antenna elements positioned generally side-by-side in a generally figure eight configuration.

20. The antenna assembly of claim 1, further comprising a reflector element spaced-apart from the tapered loop antenna element for reflecting electromagnetic waves generally towards the tapered loop antenna element.

21. An antenna assembly comprising:

a tapered loop antenna element having a generally annular shape with an opening;

a rotatably convertible support including a base and an upper portion coupled to the tapered loop antenna element, the upper portion rotatable relative to the base between a first configuration for supporting the tapered loop antenna element on a horizontal surface and a second configuration for supporting the tapered loop antenna element from a vertical surface;

one or more stops for retaining the rotatably convertible support in the first configuration and/or second configuration;

wherein:

the one or more stops include first and second stops configured to be engagingly received within first and second openings, respectively, for retaining the rotatably convertible support in the corresponding first or second configuration;

the engagement of the first stop within the first opening inhibits relative rotation of the upper portion and the base thus helping retain the rotatably convertible support in the first configuration; and the engagement of the second stop within the second opening inhibits relative rotation of the upper portion and the base thus helping retain the rotatably convertible support in the second configuration.

22. The antenna assembly of claim 21, wherein:

the upper portion includes the first and second stops; and the base includes the first and second openings.

23. The antenna assembly of claim 21, wherein the first and second stops includes one or more of a projection, nub, protrusion, and/or protuberance.

24. The antenna assembly of claim 21, wherein the one or more stops are configured to provide a tactile and/or audible indication to a user to stop rotating the upper portion relative to the base when the first and second stop is engaged into the corresponding first or second opening.

* * * * *